US011982506B2

(12) United States Patent
Lamarche

(10) Patent No.: US 11,982,506 B2
(45) Date of Patent: May 14, 2024

(54) MAGAZINE AMMUNITION UNLOADER AND MAGAZINE CONTAINER FOR MAGAZINE AMMUNITION UNLOADER

(71) Applicant: AMMUNITION MANAGEMENT TECHNOLOGIES INC., Ottawa (CA)

(72) Inventor: François Lamarche, Ottawa (CA)

(73) Assignee: AMMUNITION MANAGEMENT TECHNOLOGIES INC., Ottawa (CA)

( * ) Notice: Subject to any disclaimer, the term of this patent is extended or adjusted under 35 U.S.C. 154(b) by 0 days.

(21) Appl. No.: 17/992,137

(22) Filed: Nov. 22, 2022

(65) Prior Publication Data

US 2023/0160649 A1 May 25, 2023

Related U.S. Application Data

(60) Provisional application No. 63/281,777, filed on Nov. 22, 2021.

(51) Int. Cl.
*F41A 9/82* (2006.01)
*F41A 9/64* (2006.01)

(52) U.S. Cl.
CPC . *F41A 9/82* (2013.01); *F41A 9/64* (2013.01)

(58) Field of Classification Search
CPC ..... F41A 9/82; F41A 9/83
See application file for complete search history.

(56) References Cited

U.S. PATENT DOCUMENTS 1,306,019 A * 6/1919 Nelson ..... F41A 9/83 89/33.02
1,786,537 A 12/1930 Vaclav
2,386,376 A * 10/1945 Whitmore ..... F41A 31/00 73/167
2,451,521 A * 10/1948 Uglum ..... F41A 9/83 86/47
3,529,509 A * 9/1970 Vuceta ..... F41A 9/30 89/33.03
3,747,469 A 7/1973 Ashley
4,173,211 A * 11/1979 Crawford, Jr. ..... F41B 11/55 221/266
4,574,511 A 3/1986 Csongor
4,600,120 A 7/1986 Sabo
4,632,257 A 12/1986 Negishi
4,706,402 A 11/1987 Csongor
4,739,572 A 4/1988 Brandenburg
4,823,983 A 4/1989 Groover
4,879,829 A * 11/1989 Miller ..... F41A 9/83 42/87
4,939,862 A * 7/1990 Brandenburg ..... F41A 9/83 42/87
4,984,710 A 1/1991 Oike
(Continued)

*Primary Examiner* — Derrick R Morgan
(74) *Attorney, Agent, or Firm* — Benoit&Cote Inc.; Mathieu Audet

(57) ABSTRACT

A magazine ammunition unloader may include a body comprising: a magazine loading conduit adapted to receive a magazine containing ammunitions and the ammunitions contained in the magazine; and an ammunition ejecting conduit connected to the magazine loading conduit; and a wheel housed in the body, the wheel comprising a tooth adapted to push one at the time the ammunitions from the magazine into the ammunition ejecting conduit; and driving means adapted to drive the wheel, thereby ejecting one at the time the ammunitions from the magazine.

18 Claims, 29 Drawing Sheets

(56) References Cited

U.S. PATENT DOCUMENTS

| | | | | |
|---|---|---|---|---|
| 5,301,449 | A * | 4/1994 | Jackson | F41A 9/83 86/47 |
| 8,453,366 | B2 | 6/2013 | Gray | |
| 8,931,199 | B1 | 1/2015 | Cauley, Jr. | |
| 9,003,687 | B2 | 4/2015 | Cauley, Jr. | |
| 9,182,185 | B2 * | 11/2015 | Hatch | F41A 9/67 |
| 9,335,108 | B2 | 5/2016 | Cauley, Jr. | |
| 9,574,836 | B1 | 2/2017 | Cauley, Jr. | |
| 9,612,070 | B2 * | 4/2017 | Hatch | F41A 9/83 |
| 9,995,548 | B1 | 6/2018 | Zhou | |
| 10,132,582 | B1 | 11/2018 | Zhou | |
| 10,156,408 | B1 * | 12/2018 | Buckner | F41A 9/83 |
| 10,222,154 | B1 * | 3/2019 | Roe | F41A 9/83 |
| 10,852,087 | B1 * | 12/2020 | Witecha | F41A 9/84 |
| 11,536,527 | B1 * | 12/2022 | Selph | F41A 9/83 |
| 11,635,267 | B1 * | 4/2023 | Rosenblum | F41A 9/83 42/87 |
| 11,867,475 | B2 * | 1/2024 | Kim | F41A 9/83 |
| 2005/0081421 | A1 | 4/2005 | Guy | |
| 2013/0067788 | A1 | 3/2013 | Gray | |
| 2014/0033592 | A1 | 2/2014 | Fiorucci | |
| 2014/0317985 | A1 | 10/2014 | Cauley, Jr. | |
| 2016/0102932 | A1 * | 4/2016 | Cobb | F41A 9/83 42/87 |
| 2019/0107350 | A1 * | 4/2019 | Hefer | F41A 9/83 |
| 2020/0049438 | A1 * | 2/2020 | Hatch | F41A 9/67 |
| 2021/0080206 | A1 * | 3/2021 | Fischer | F41A 9/83 |
| 2022/0011065 | A1 * | 1/2022 | Derus | F41A 9/83 |
| 2023/0358492 | A1 * | 11/2023 | Tippmann, Jr. | F41A 9/83 |

* cited by examiner

MAGAZINE AMMUNITION UNLOADER AND MAGAZINE CONTAINER FOR MAGAZINE AMMUNITION UNLOADER

CROSS-REFERENCE TO RELATED APPLICATION

This application relates to and is a non-provisional application claiming priority under 35 U.S.C. § 119(e) from U.S. provisional patent application Ser. No. 63/281,777, filed Nov. 22, 2021, under 35 U.S.C. § 111, entitled MAGAZINE AMMUNITION UNLOADER AND MAGAZINE CONTAINER FOR MAGAZINE AMMUNITION UNLOADER, the specification of which is hereby incorporated herein by reference in its entirety.

BACKGROUND

(A) Field

The subject matter disclosed generally relates to an ammunition magazine unloader and associated box. More particularly, the subject matter disclosed relates to an ammunition magazine unloader with a mechanism for removing the ammunition from the magazine and for transferring the ammunition into a storage container.

(b) Related Prior Art

Ammunitions are packaged in strips thereof, boxes thereof or ammunition containers, Rounds are individually loaded in each magazine. All ammunitions are not always used during a shooting session, so magazines are frequently half-full at the end of shooting sessions, and the ammunition is required to be transferred out of the magazine for storage.

There is therefore a need for a solution to ease the process of unloading ammunition from a magazine for storage between shooting sessions.

SUMMARY

In some aspects, the techniques described herein relate to a magazine ammunition unloader including: a body including: a magazine loading conduit adapted to receive a magazine containing ammunitions and the ammunitions contained in the magazine; and an ammunition ejecting conduit connected to the magazine loading conduit; and a wheel housed in the body, the wheel including a tooth adapted to push one at the time the ammunitions from the magazine into the ammunition ejecting conduit; and driving mechanism adapted to drive the wheel, thereby ejecting one at the time the ammunitions from the magazine.

In some aspects, the techniques described herein relate to a magazine ammunition unloader, wherein the wheel includes at least one tooth.

In some aspects, the techniques described herein relate to a magazine ammunition unloader, wherein the ammunitions includes a rear face, and wherein the tooth includes a pushing face for pushing the rear face of a pushed one of the ammunitions.

In some aspects, the techniques described herein relate to a magazine ammunition unloader, wherein the pushing face is sloped frontward and outward relative to a radius line of wheel.

In some aspects, the techniques described herein relate to a magazine ammunition unloader, wherein the tooth includes a top face for preventing a next one of the ammunitions to penetrate in the ammunition ejection conduit when the pushing face push the rear face of the pushed ammunition.

In some aspects, the techniques described herein relate to a magazine ammunition unloader, wherein junction between the pushing face and the top face defines a rounded edge.

In some aspects, the techniques described herein relate to a magazine ammunition unloader, wherein the tooth includes a rear face providing clearance between the ammunitions the wheel.

In some aspects, the techniques described herein relate to a magazine ammunition unloader, wherein the magazine has an internal width in which the ammunitions are housed, wherein the tooth has a thickness that is at least equal to half of the internal width of the magazine.

In some aspects, the techniques described herein relate to a magazine ammunition unloader, wherein the wheel includes at least four (4) teeth.

In some aspects, the techniques described herein relate to a magazine ammunition unloader, further including a roller rotatably mounted about a junction of the magazine loading conduit and the ammunition ejecting conduit.

In some aspects, the techniques described herein relate to a magazine ammunition unloader, wherein the ammunition ejecting conduit includes walls, and wherein the roller extends inwardly into the ammunition ejecting conduit beyond one of the walls of the ammunition ejecting conduit.

In some aspects, the techniques described herein relate to a magazine ammunition unloader, wherein the roller is made of metal or plastic.

In some aspects, the techniques described herein relate to a magazine ammunition unloader, further including locking mechanism adapted to releasably lock the magazine in the magazine loading conduit.

In some aspects, the techniques described herein relate to a magazine ammunition unloader, wherein the locking mechanism includes a spring-loaded arm.

In some aspects, the techniques described herein relate to a magazine ammunition unloader, wherein the magazine loading conduit includes a first wall and a second wall opposed to the first wall, wherein the first wall and the second wall are not parallel to each other.

In some aspects, the techniques described herein relate to a magazine ammunition unloader, wherein the driving mechanism includes a handle.

In some aspects, the techniques described herein relate to a magazine ammunition unloader, wherein the body includes a main part housing the wheel, and an arm extending from the main part and including a hook portion distant from the main part of the body.

In some aspects, the techniques described herein relate to a magazine ammunition unloader, wherein the arm is rotatably joined to the main part of the body.

In some aspects, the techniques described herein relate to a magazine ammunition unloader, wherein the body further includes an abutting face, wherein the abutting face and the hook portion are cooperating into mounting the magazine ammunition unloader to an ammunition container.

In some aspects, the techniques described herein relate to a magazine ammunition unloader, wherein the ammunition ejecting conduit includes a bottom end defining protrusions and recesses designed to cooperate with projections and gaps of an ammunition container.

In some aspects, the techniques described herein relate to a loading interface adapted to provide an interface between a) a filling container loaded with ammunitions, wherein the filling container has a filling open-top, and, and b) a receiving container having a receiving open-top and adapted, wherein the receiving container is adapted to be filled with the ammunitions from the filling container, the loading interface including: a pair of arms mounted to the receiving container; a container interface adapted to slidingly mount the filling container to the loading interface, and a plate adapted at least at least partially blocking the filling open-top; a pair of pivots adapted to allow a rotation of the container interface relative to the arms between a normal position and a filling position, wherein the rotation of the container interface in the filling position results in the filling container mounted thereto to have the filling open-top facing down, and wherein sliding the filling container at least partially out of the container interface while in the filling position allows aligning the open tops of the filling container and of the receiving container thereby allowing the ammunitions contained in the filling container to fall into the receiving container.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which:

FIGS. 21 to 23 are perspective views of respectively the magazine ammunition unloader being in process of being secured to the ammunition container, the magazine ammunition unloader secured to the ammunition container, and the magazine loaded to the magazine ammunition unloader secured to the ammunition container;

FIG. 36 is a perspective view of a first part of the ammunition container of FIG. 34;

It will be noted that throughout the appended drawings, like features are identified by like reference numerals.

DETAILED DESCRIPTION

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations, and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

Figure 5:
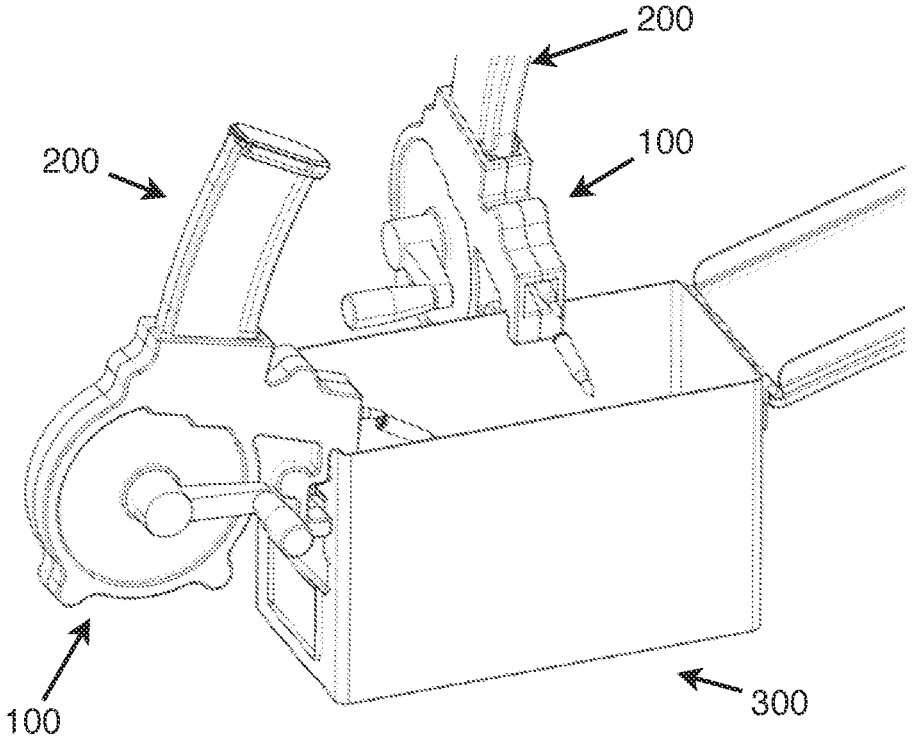
FIG. 5 is a perspective view of the magazine ammunition unloaders of FIG. 4 loaded with the magazines, and mounted to the ammunition container.
Figure 23:
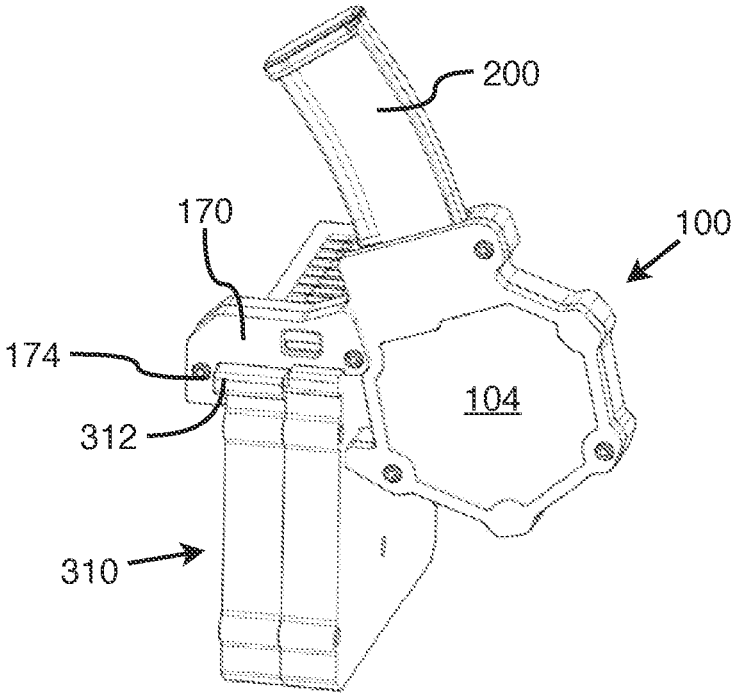
Figure 24:
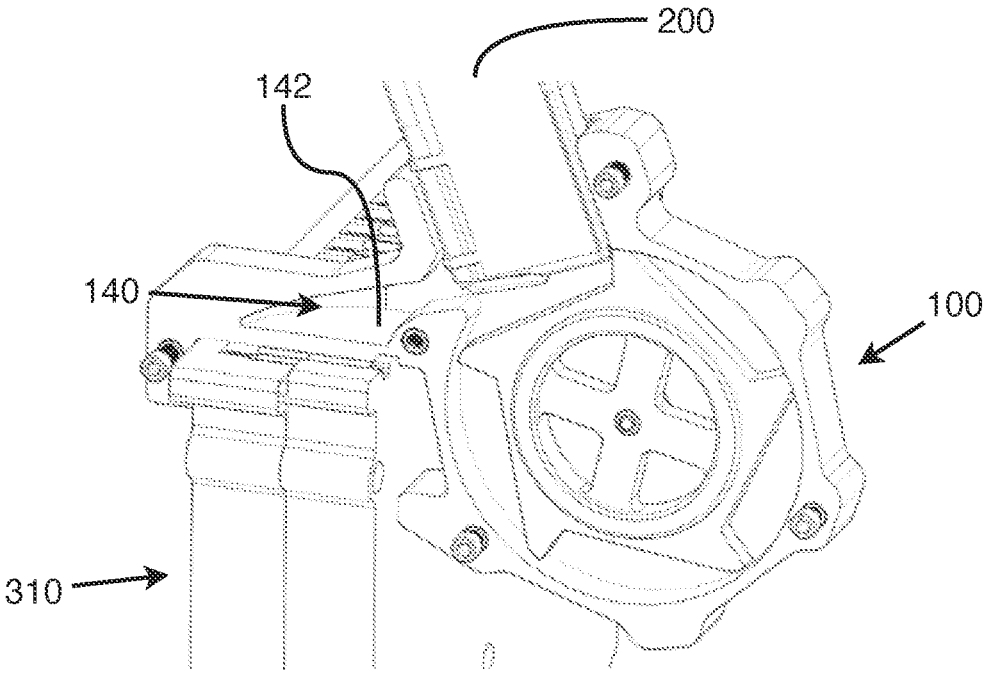
FIGS. 24 to 29 are perspective views, with one half body of the magazine ammunition unloader removed, of ammunitions being unloaded from a magazine into the ammunition container of FIG. 20.
Figure 25:
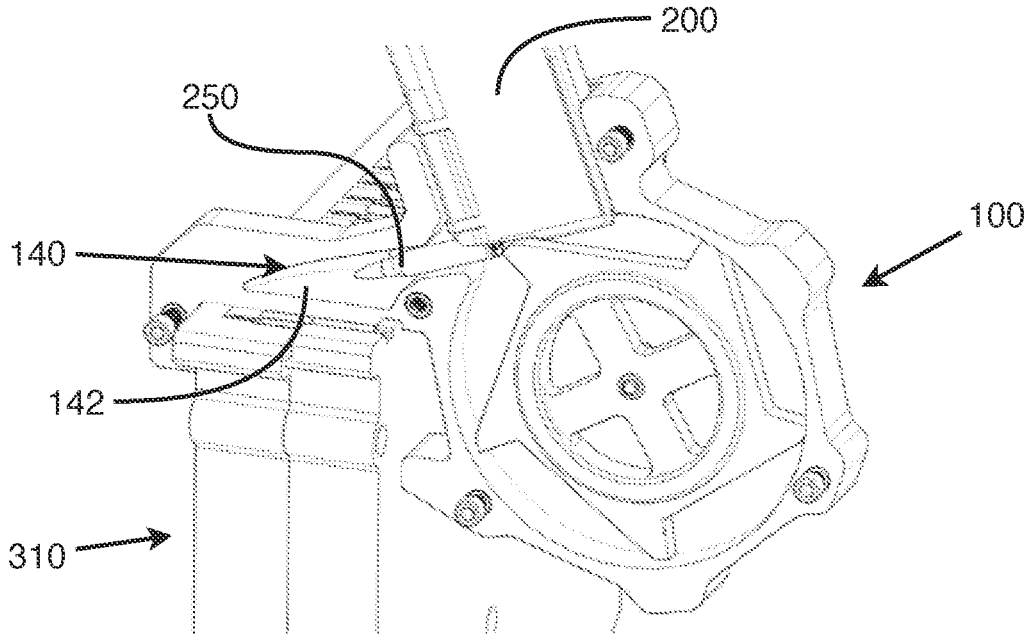
Figure 26:
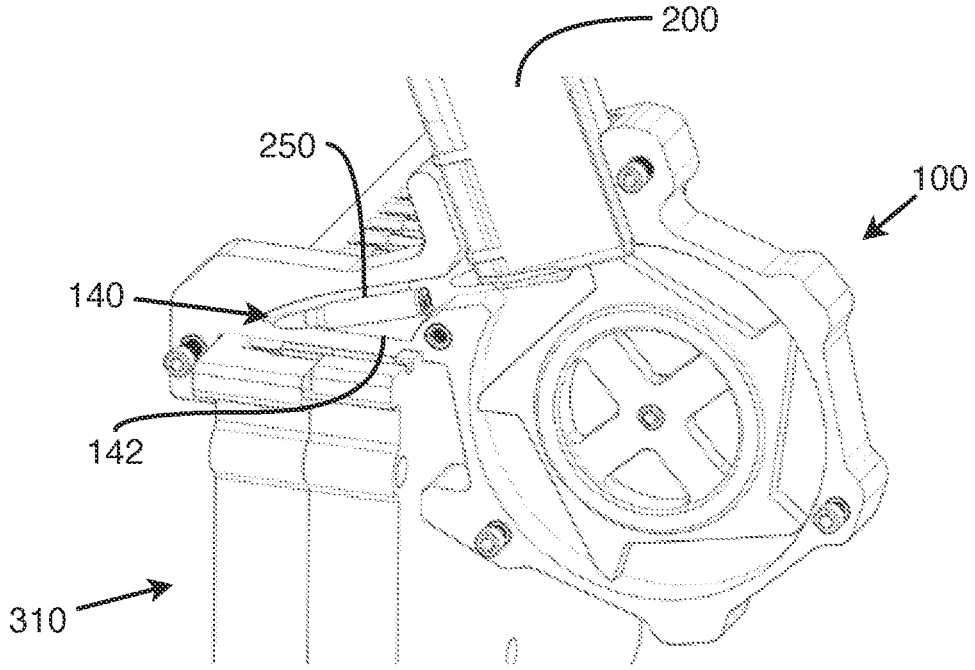
Figure 27:
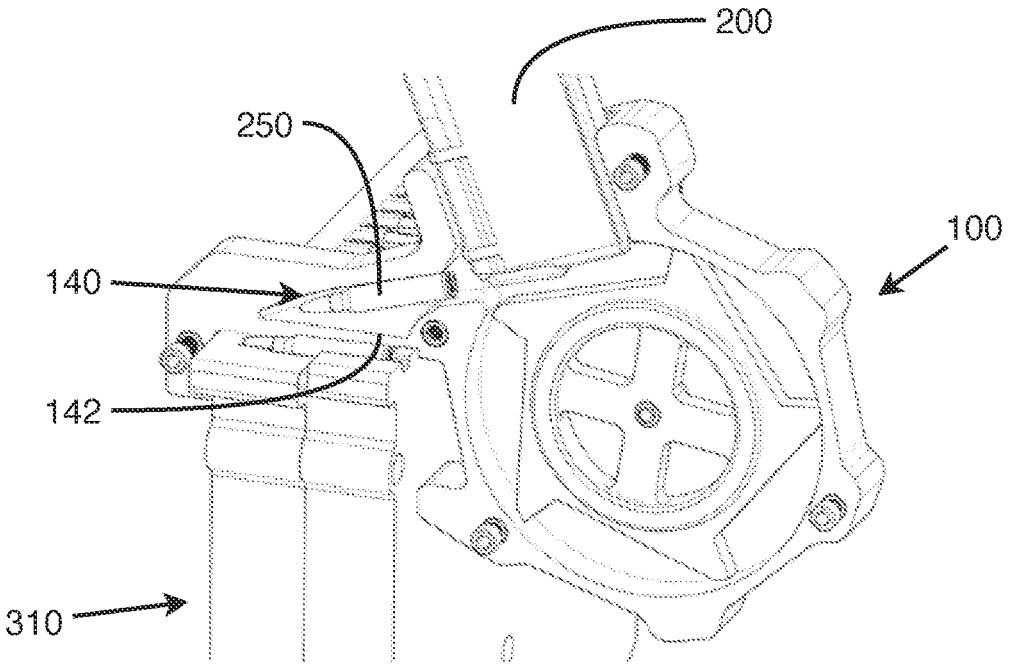
Figure 39:
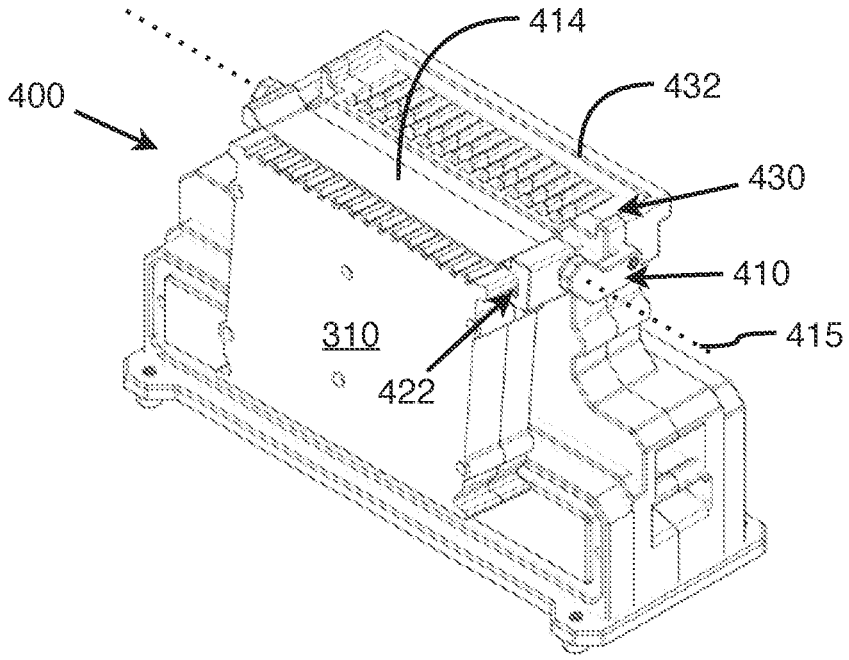
Figure 40:
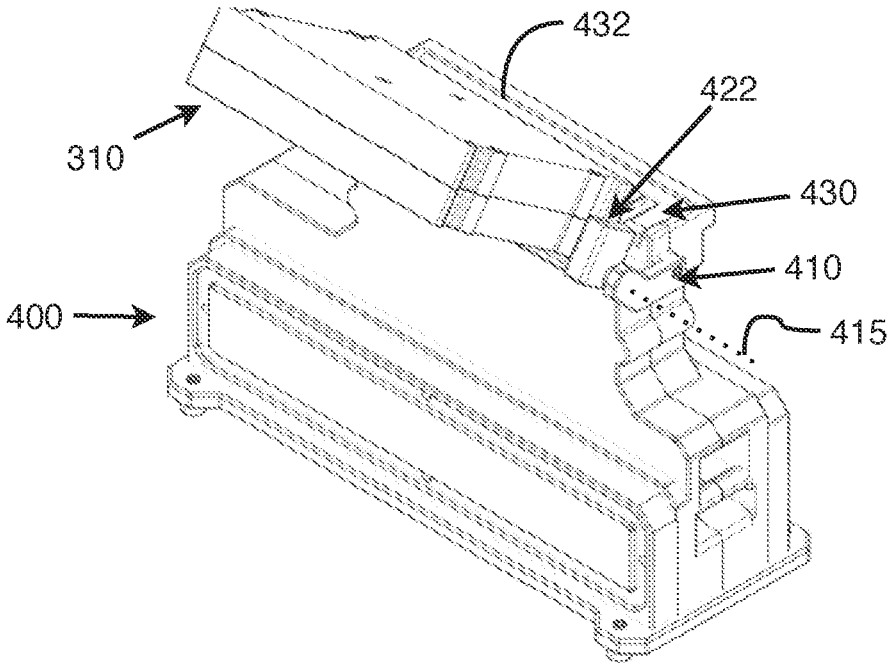
Figure 41:
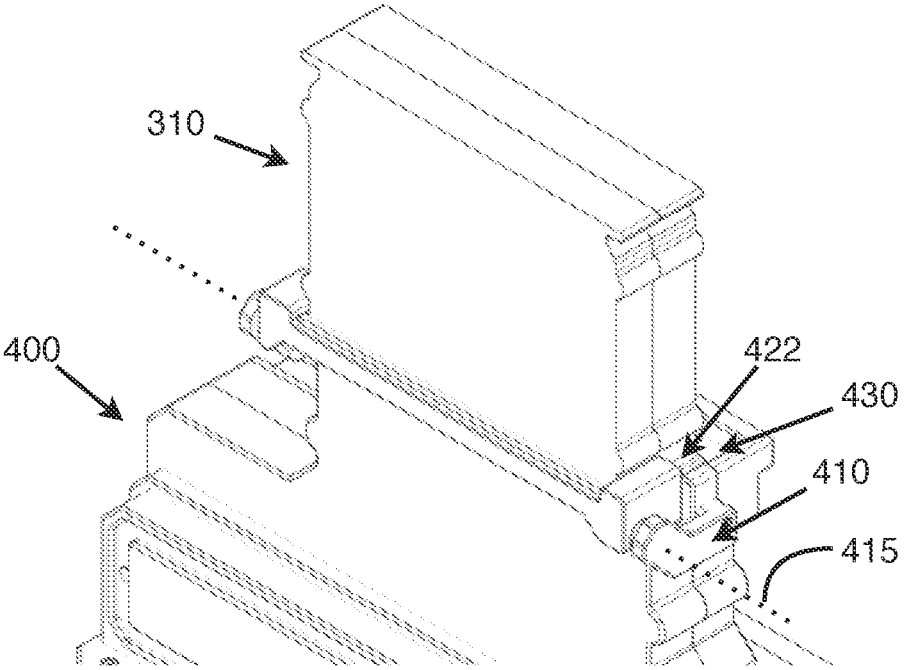

The terms "top", "up", "upper", "bottom", "lower", "down", "vertical", "horizontal", "interior" and "exterior" and the like are intended to be construed in their normal meaning in relation with the normal operation of the product, with the orientation of the magazine ammunition unloader in normal orientation being depicted, inter alia, on FIGS. 5, 23 and 39.

It should further be noted that for purposes of this disclosure, the terms "coupled", "connected" and "joined" mean the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate members being attached to one another. Such joining may be permanent in nature or alternatively may be removable or releasable in nature.

In realizations, there are disclosed, inter alia, a magazine ammunition unloader 100.

Figure 1:
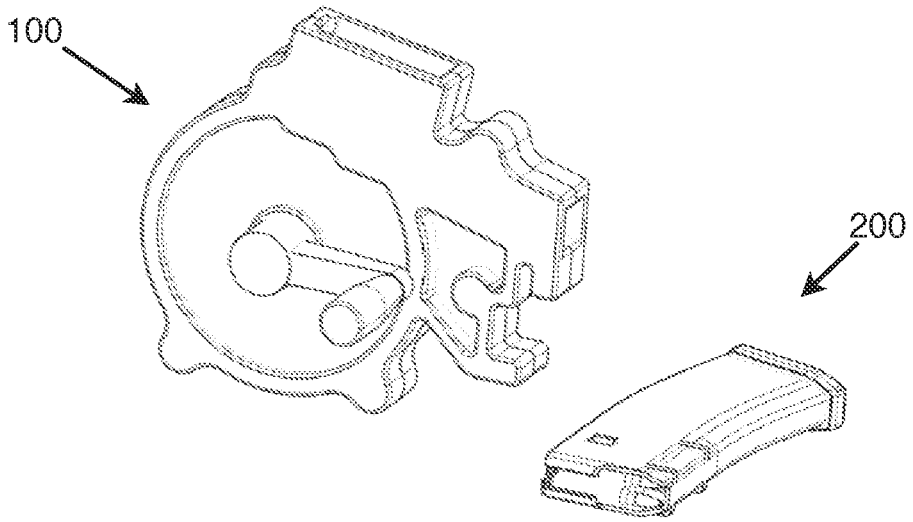
FIG. 1 is a perspective view of the magazine ammunition unloader with a magazine aside from the magazine ammunition unloader in accordance with an embodiment.
Figure 2:
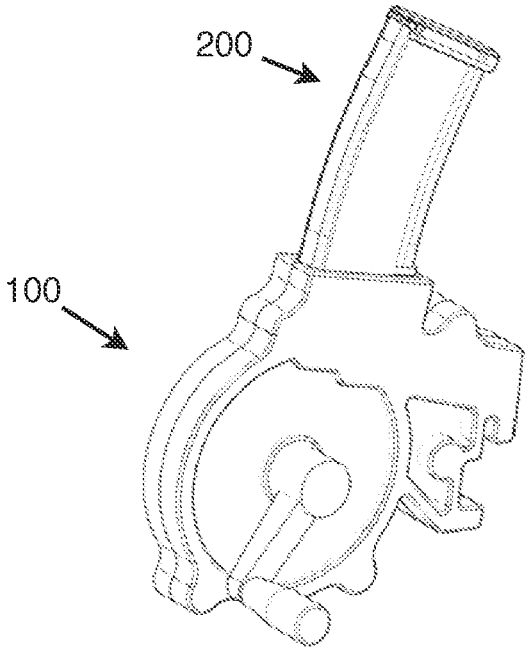
FIG. 2 is a perspective view of the magazine ammunition unloader of FIG. 1 with a magazine loaded therein.
Figure 3:
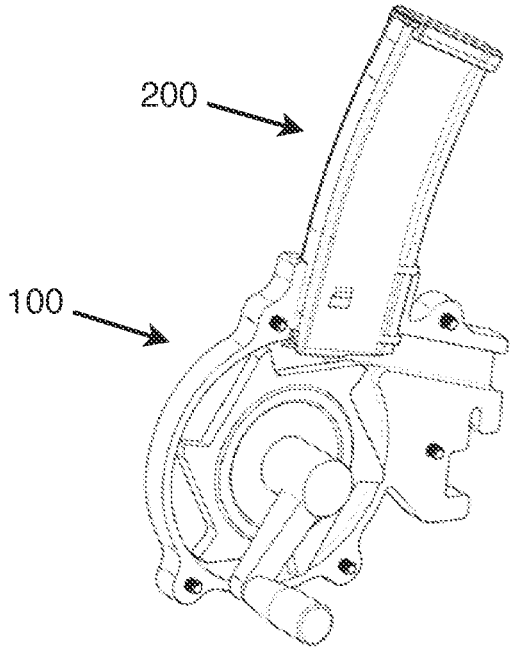
FIG. 3 is a perspective view of the magazine and the magazine ammunition unloader of FIG. 2 with the cover of the magazine ammunition unloader removed.

Referring now to the drawings, and more particularly to FIGS. 1 to 3, a magazine ammunition unloader 100 is adapted to be loaded with ammunitions from a magazine 200. The magazine ammunition unloader 100 is adapted to ease the process of removing the ammunitions from the magazine 200 for storage.

The magazine ammunition unloader 100 is adapted to operate on a magazine 200 regardless of the number of ammunitions it contains. It is further adapted to being loaded with ammunitions from a magazine 200, regardless of the material the magazine 200 is made of, for example, a metal magazine, a polymer magazine, or a composite magazine.

Figure 4:
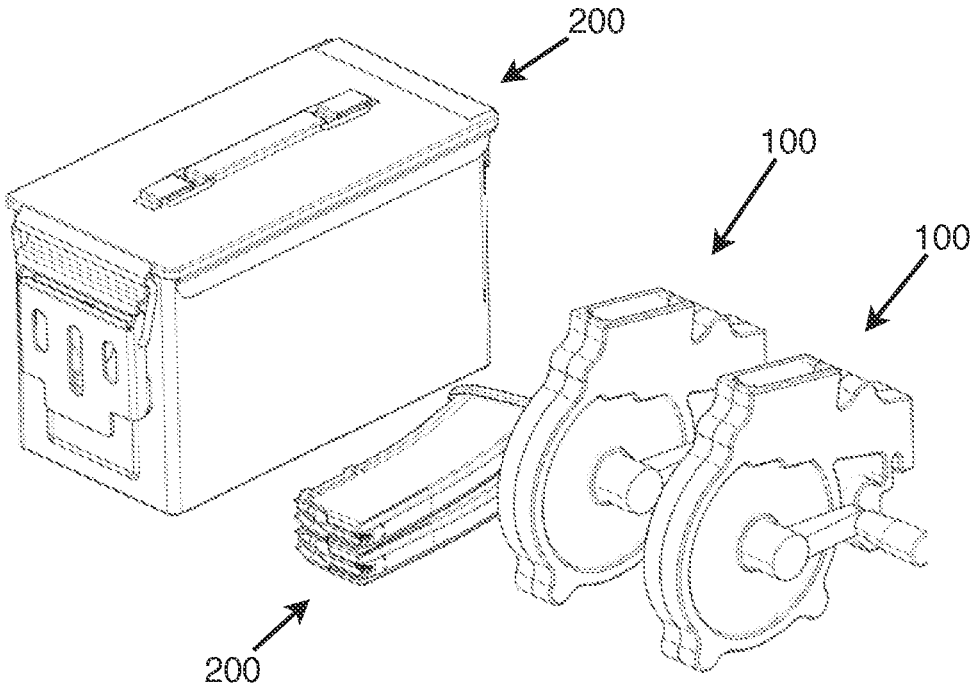
FIG. 4 is a perspective view of an ammunition container with two magazine ammunition unloaders and two magazines aside from the ammunition container in accordance with an embodiment.

Referring to FIGS. 4 and 5, the magazine ammunition unloader 100 is adapted to be operated with ammunition containers 300 of variable size and shapes. As depicted, the magazine ammunition unloader 100 may be mounted to, e.g., the narrow wall of the side wall of the exemplary open-top ammunition container 300.

Figure 6:
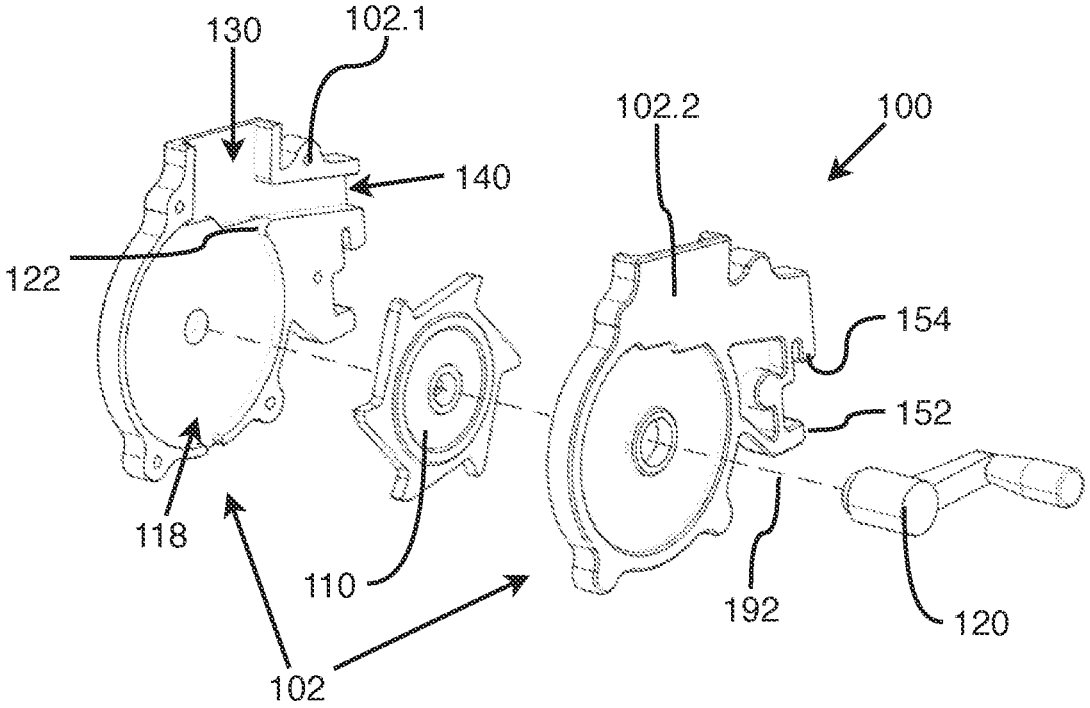
FIG. 6 is an exploded perspective view of the magazine ammunition unloader of FIG. 1.
Figure 7:
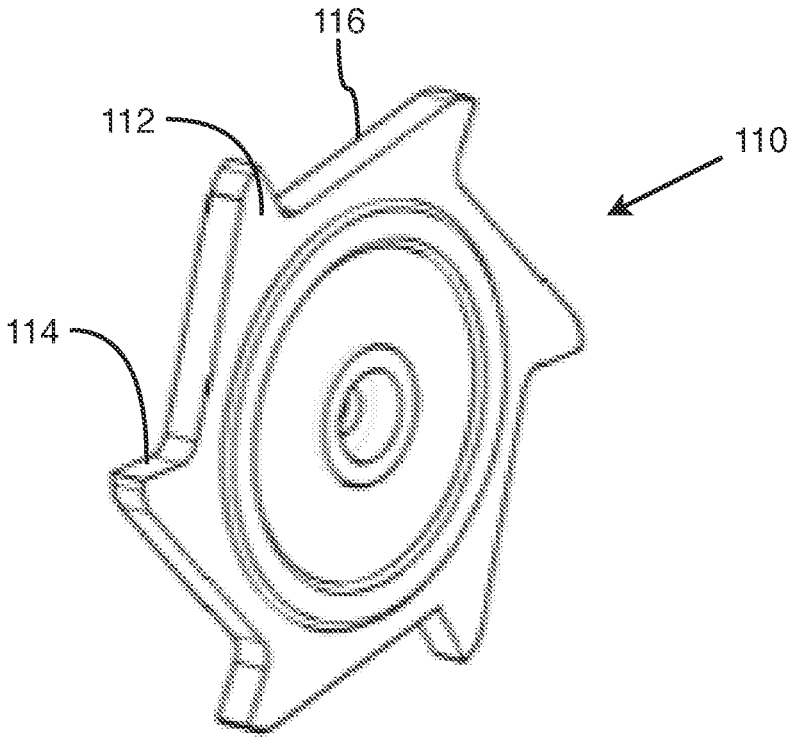
FIG. 7 is an elevated view of the wheel of a magazine ammunition unloader in accordance with an embodiment.

Referring to FIGS. 6 and 7, the magazine ammunition unloader 100 comprises a body 102 composed of two half bodies 102.1 and 102.2 jointed along a plane perpendicular to the axis 192. The body 102 defines a magazine loading conduit 130 and an ammunition ejecting conduit 140. The body 102 houses a wheel 110 rotatable around the axis 192 that is interfacing with the magazine loading conduit 130 and the ammunition ejecting conduit 140. The wheel 110 is adapted to engage with the rear of the ammunitions from a magazine 200 loaded in the magazine loading conduit 130 and to eject the ammunitions from the magazine 200 through the ammunition ejecting conduit 140. The magazine ammunition unloader 100 further comprises wheel driving means, and more particularly in case of manual operation, a handle 120 connected to the wheel 110 operable to drive the wheel 110 around the axis 192.

In a realization, the body 102 and the wheel 110 are further adapted to engage with each other such as having the body 102 guiding and ensuring co-axiality between them and the handle 120 through engageable parts, such as a circular channel adapted to receive a circular rib. A person skilled in the art would identify other solutions, contemplated therethrough, for joining the body 102, the wheel 110 and the handle 120 in a co-axial manner with the handle 120 being drivable relative to the body 102 to drive the wheel 110 to spin around its axis.

Still referring to FIGS. 6 and 7, and referring additionally to FIGS. 51 to 56, the peripheric shape of the wheel 110 is specifically designed to provide an ammunition abutting face 114 adapted to push the rear face 254 of an ammunition 250. It further comprises an ammunition guiding face 116 that provides a surface far enough from the center of the wheel 110 to ensure that the ammunition expulsed out of a magazine, if needed, would be maintained in position and enter the ammunition ejecting conduit 140 rather than wedging in the wheel housing 118 following the apex of the preceding tooth exiting the ammunition ejecting conduit 140 and entering the wheel housing 118. Accordingly, clearance between the apex of the teeth 112 and the nose 122 of the ammunition ejecting conduit 140 is small enough to participate in preventing the ammunition to engage or wedge into the wheel housing 118, while the general peripheric shape of the wheel 110, and particularly of the ammunition guiding face 116 generally helps in aligning the ammunition with the ammunition ejecting conduit 140.

Figure 51:
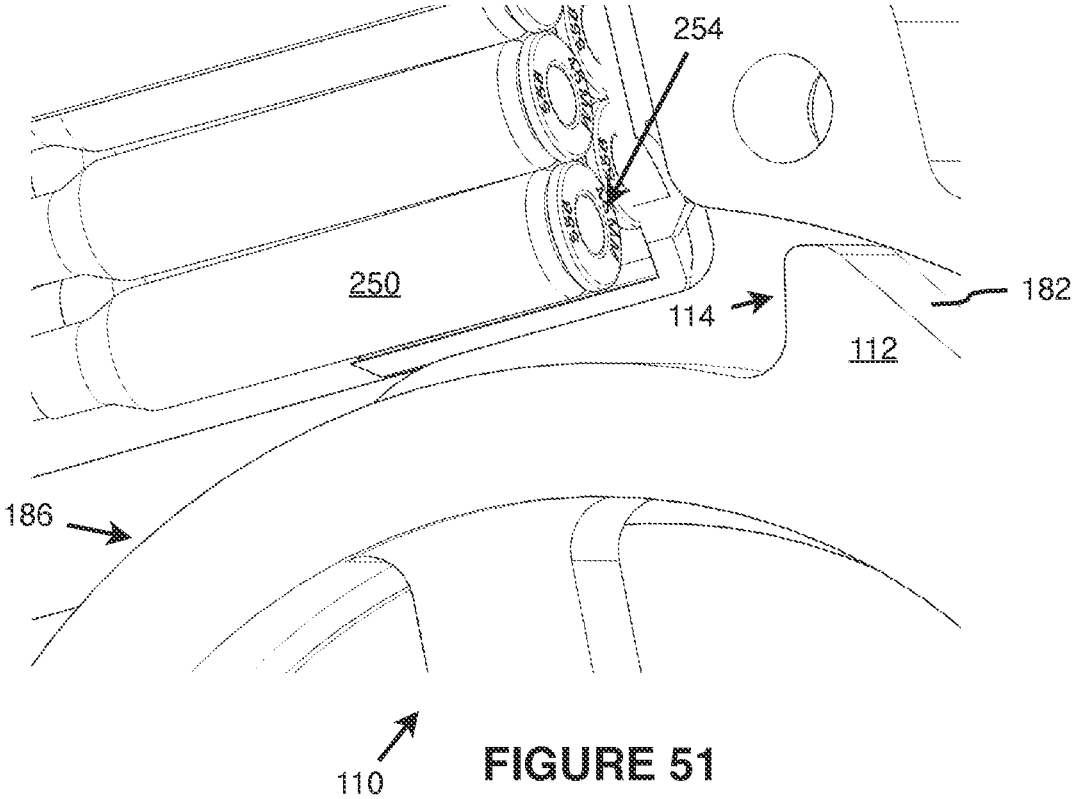
FIGS. 51 to 56 are elevation perspective views depicting the interaction of the pushing teeth of the wheel with ammunitions during the ejection of an ammunition from the magazine, the figures depicting a sequence in the ammunition ejection process in accordance with an embodiment.
Figure 52:
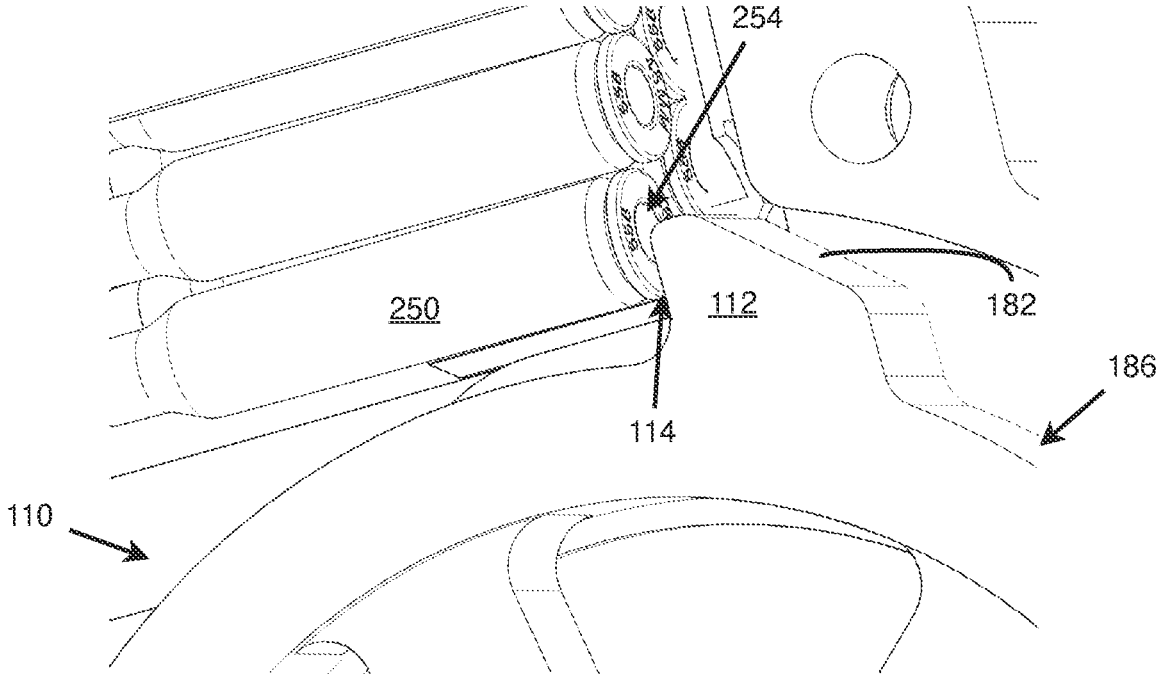
Figure 53:
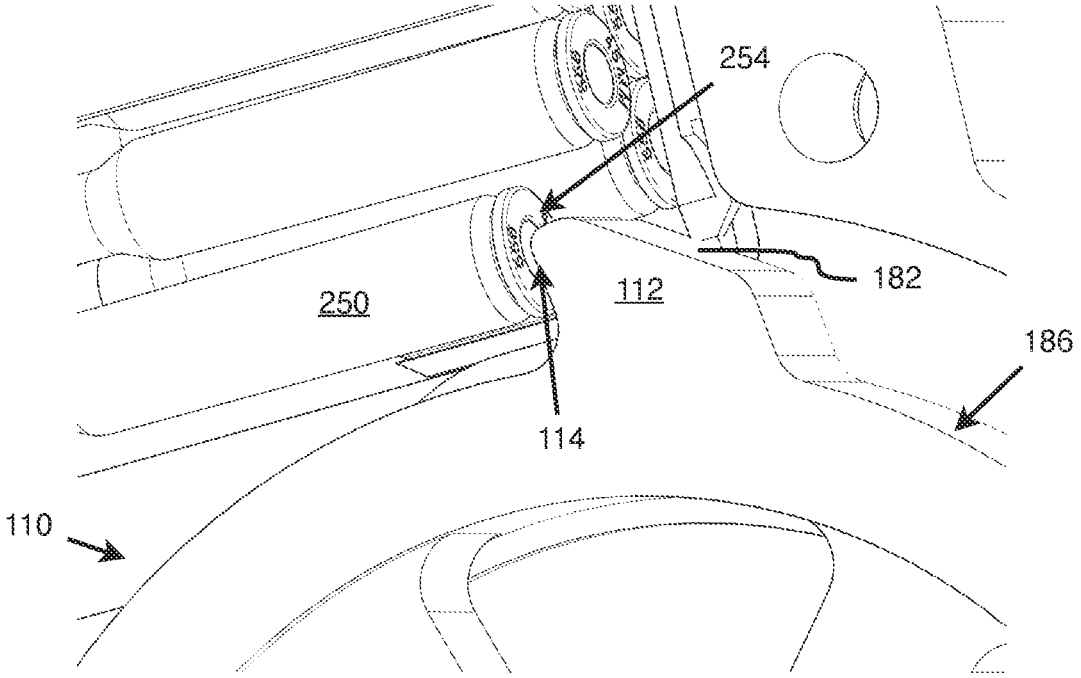
Figure 54:
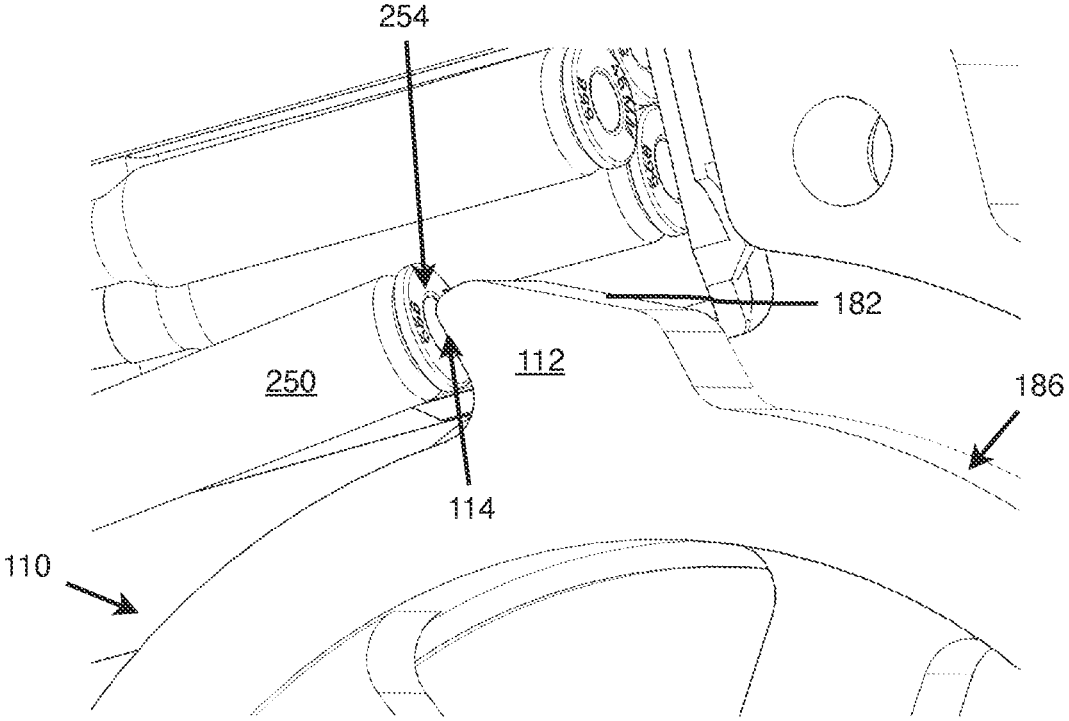
Figure 55:
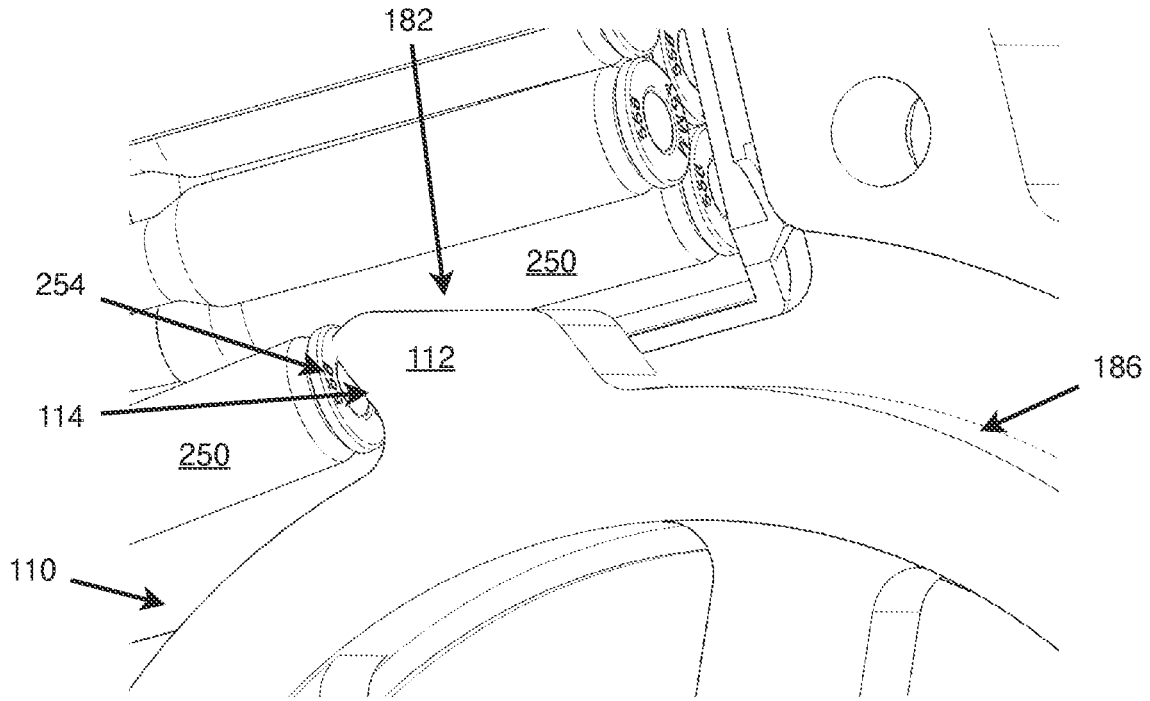
Figure 56:
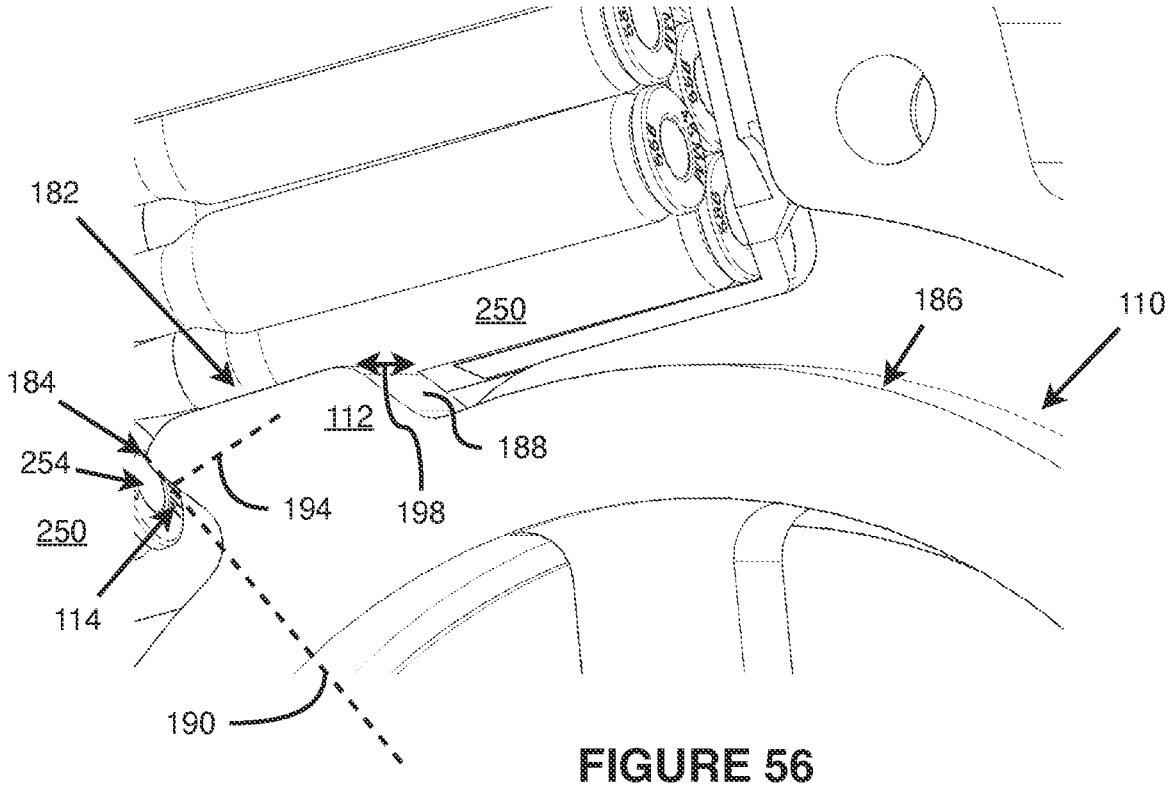

Referring particularly to FIGS. 51, to 56, a sequence in the ammunition ejection process is shown. It depicts on FIG. 51 the wheel 110 approaching the ammunitions 250; on FIG. 52 the ammunition abutting face 114 of the wheel 110 butting up against the rear face 254 of the ammunition 250; on FIG. 53 the ammunition abutting face 114 of the wheel 110, pushing the rear face 254 of the ammunition 250, thereby forcing the ammunition 250 to enter the ammunition ejecting conduit 140 (see FIG. 6) with the top face 182 of the pushing teeth 112 preventing the next ammunition 250 in the magazine 200 to move downward; on FIGS. 54 and 55 the ammunition abutting face 114 of the wheel 110 pushing furthermore the rear face 254 of the ammunition 250 forcing the ammunition 250 to engage in the ammunition ejecting conduit 140 while the next ammunition 250 in the magazine 200 to move downward following the displacement of the top face 182 of the pushing tooth 112; and on FIG. 56 the top face 182 of the pushing teeth 112 of the wheel 110 having moved forward such as providing clearance for the next ammunition 250 in the magazine 200 to move to is the most downward position in the magazine 200 following the displacement of the top face 182 of the pushing tooth 112 frontward to a retaining position.

It is to be noted that the wheel 110 of the embodiment depicted through FIGS. 51 to 56 features pushing teeth 112 protruding from a generally cylindrical body 186 with the front face 114 of the pushing teeth 112 being slightly outwardly-forwardly sloped relative to a virtual radius line 190 (depicted on FIG. 56) joining the axis 192 of the wheel 110 (depicted on FIG. 6) to the frontmost surface 184 of the pushing teeth 112. The junction of the front face 114 and the top face 182 of the pushing teeth 112 is rounded. The top face 182 features an outward-frontward slope relative to a tangential line 194. The top face 182 joins to a rear face 188 providing clearance between the rear end of the top face 182 and the portion of the cylindrical body 186 present before the next pushing tooth 112.

Figure 19:
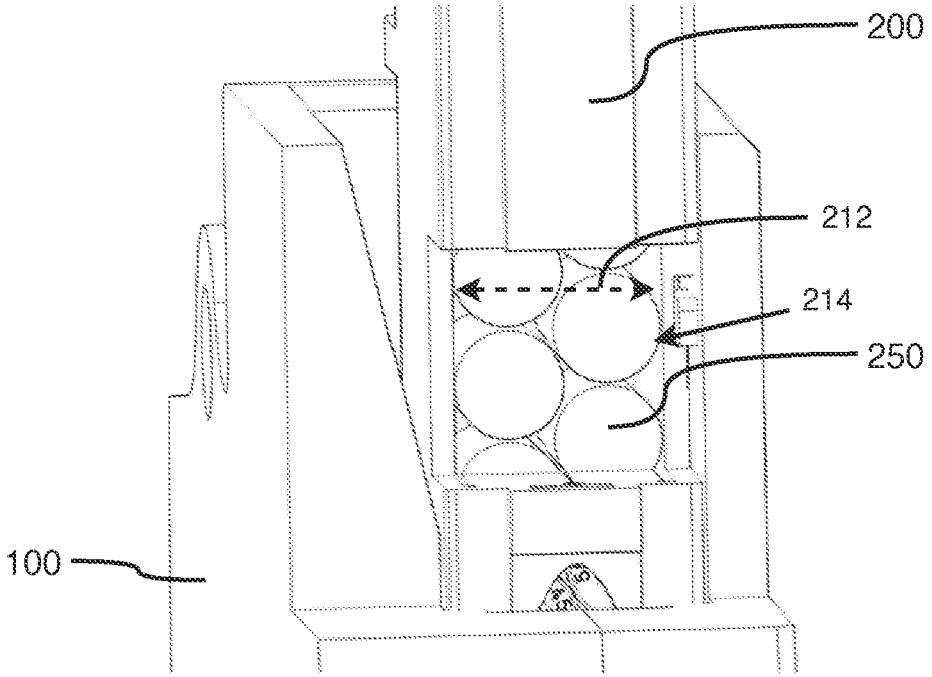
FIG. 19 is a close-up front view of a portion of a magazine loaded in a magazine ammunition unloader according to a realization, with a portion of the magazine removed to depict ammunitions loaded in the magazine.

Referring additionally to FIG. 19, it is to be noted that the pushing teeth 112 have a thickness 198 (parallel to the axis 192, FIG. 6) that is equal to or smaller than the internal width 212 (see FIG. 19) of the magazine 200 housing the ammunitions 250, and preferably equal or larger than the transversal distance between the center of two ammunitions 250, preferably about half of the internal width 212 of the magazine 200. According to a preferred embodiment, the center of the teeth 112 in the axial (thickness-related) direction is about aligned with the center line of the channel 214 housing the magazine 200.

It is without saying that the wheel 110 is designed for the dimensions of ammunitions, and that ammunitions having different dimensions (e.g., length) would potentially result in a wheel 110 having a modified shape or dimensions.

According to a realization, the wheel 110 comprises several teeth 112, e.g., six (6) teeth 112 each defining an ammunition abutting face 114 and an ammunition guiding face 116, wherein the minimum length of the ammunition guiding face 116 is sized based on the ammunition length, or in other words the minimum distance between the teeth 112 is sized based in the rounds to be unloaded from a magazine plus a tolerance.

According to a particular realization, the ammunition abutting face 114 and the ammunition guiding face 116 are generally flat. The length of the ammunition guiding face 116 is more than three times the height of the ammunition abutting face 114.

However, the present description contemplated therethrough other shapes of surfaces, including the face(s) comprising recess(es), and convex section(s), e.g., a convex arched ammunition guiding face having a ray of curvature more than three times the diameter of the wheel 110 based on the teeth apex.

According to a realization, the thickness of the wheel 110, and more particularly of the ammunition abutting face 114 is more than half the diameter of the foot of an ammunition, and preferably more than three-quarters of the diameter of the ammunition, whereby the ammunition abutting face 114 is adapted to push an ammunition regardless of the position (right or left) of the ammunition 250 in the magazine 200 as depicted on FIG. 19.

Referring now particularly to FIGS. 47 to 50, a sequence in the ammunition ejection process, and particular engagement of the ammunition 250 in the ammunition ejecting conduit 140 is shown. It depicts on FIG. 47 a pushing tooth 112 pushing an ammunition 250 toward the ammunition ejecting conduit 140, with the directing roller 126 directing the head 252 of the ammunition 250 slightly downward while rolling, thus minimizing friction in-between while preventing the head 252 of the ammunition 250 to wedge in contact of an edge or surface; on FIG. 48 the pushing tooth 112 pushing forward the ammunition 250 and the directing roller 126 continuing guiding the ammunition 250 toward the ammunition ejecting conduit 140; on FIGS. 49 and 50 the pushing tooth 112 pushing forward the ammunition 250 and the directing roller 126 continues guiding the ammunition 250 toward the ammunition ejecting conduit 140, rolling over the ammunition 250, with the unregular profile of the ammunition 250 not preventing the directing roller 126 to continue guiding the ammunition 250 over the whole length of the ammunition 250.

Referring back to FIGS. 6 and 7, the magazine ammunition unloader 100 further comprises a container abutting face 152 and a mounting groove 154 adapted to have the top edge of a wall inserted into it. Accordingly, the combination of the container abutting face 152 and the mounting groove 154 allows mounting the magazine ammunition unloader 100 to the wall of an ammunition container.

Referring to FIGS. 8 to 12, the magazine ammunition unloader 100 has a magazine 200 loaded therein. FIGS. 8 to 12 depicts, according to an embodiment, the operation of unloading ammunitions 250 from the magazine 200.

Figure 8:
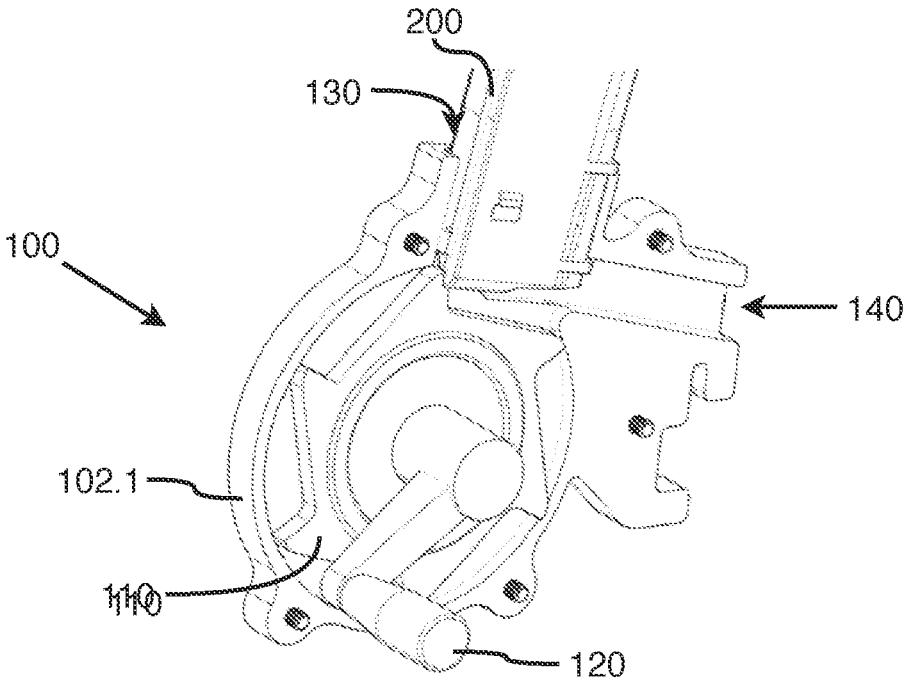
FIGS. 8 to 12 are perspective views of an embodiment of a magazine ammunition unloader with a magazine loaded into and a half of the body removed, during the operation of unloading ammunitions from the magazine in accordance with an embodiment.

FIG. 8 depicts the magazine 200 being loaded in the magazine loading conduit 130.

Figure 9:
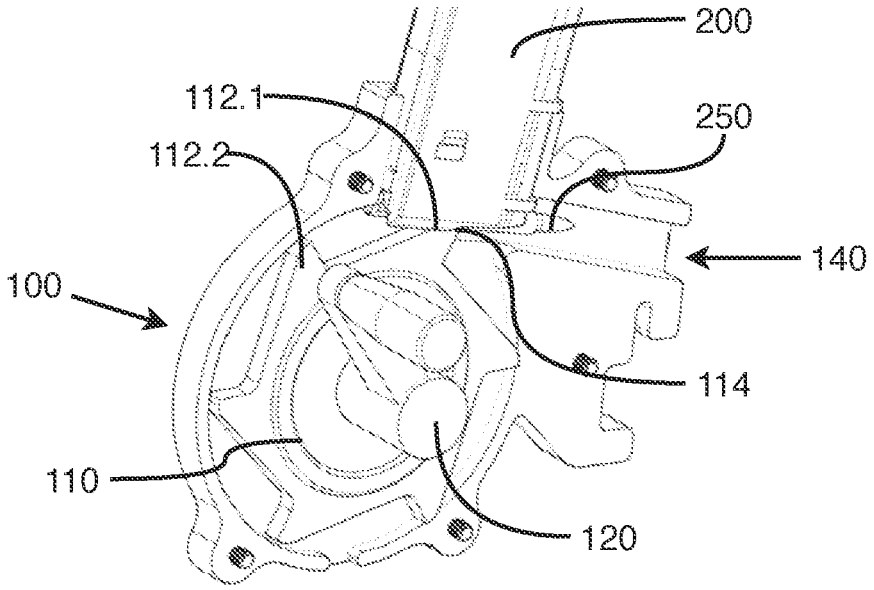
Figure 10:
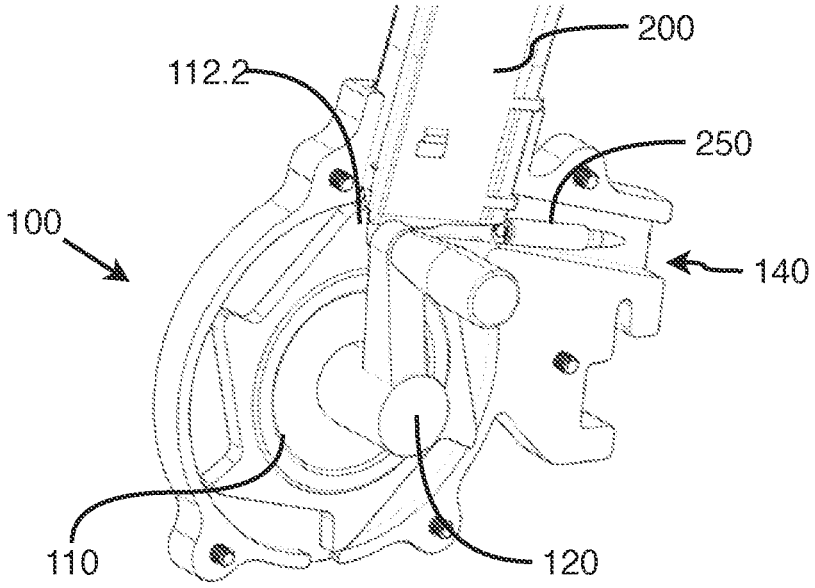

FIGS. 9 and 10 depict that, under the handle 120 being turned clockwise, the face 114 of a tooth 112 pushed the rear of the bottom ammunition 250 with the ammunition being expulsed thereby outside of the magazine 200 and into the ammunition ejecting conduit 140.

FIG. 10 also depicts that, like when the first ammunition 250 was ejected into the ammunition ejecting conduit 140, the face 114 of the following tooth 112.2 (following the first tooth 112.1 having already moved out of the course of the ammunitions 250) meets the following ammunition 250 on the magazine 200 to begins the ejection process while the first ejected ammunition 250 is ejected from the ammunition ejecting conduit 140.

Figure 11:
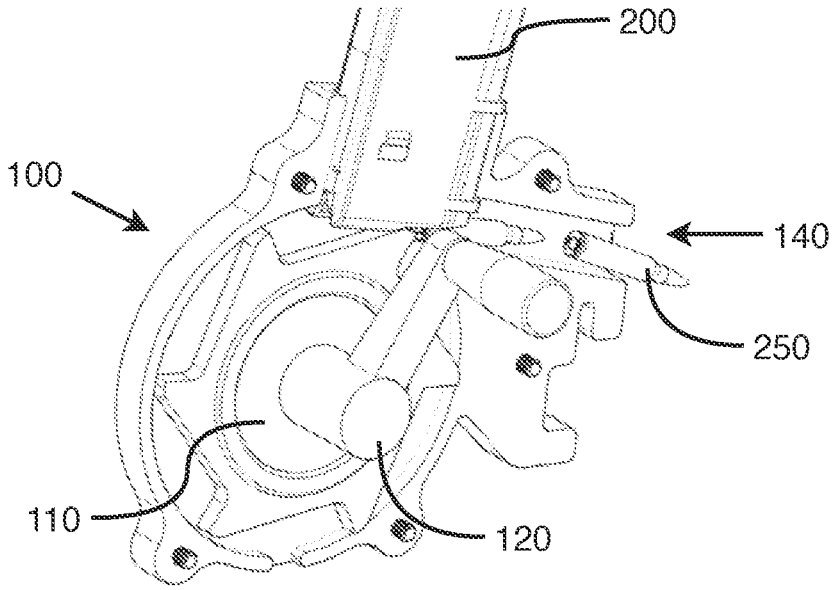
Figure 12:
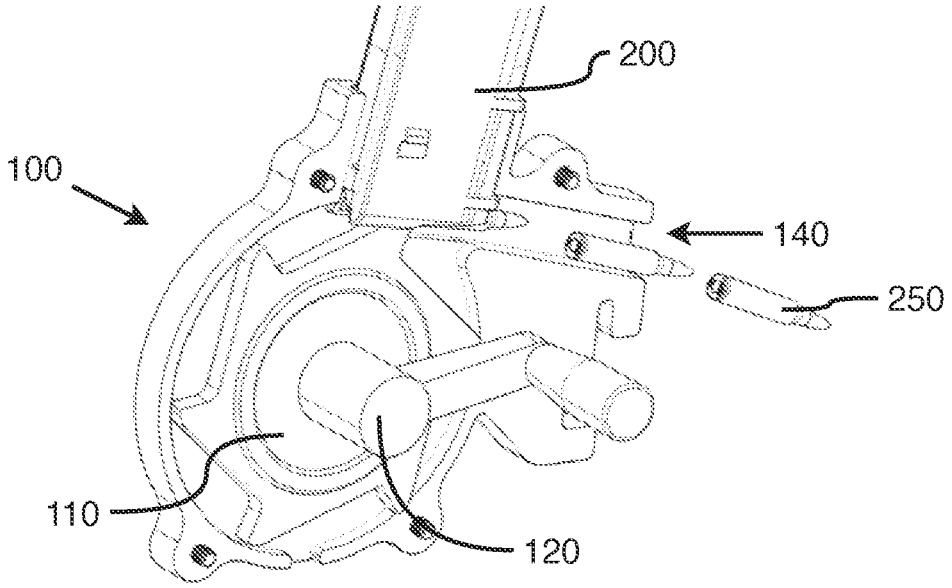

FIGS. 11 and 12 depict that, as the handle 120 is turned clockwise, more than one ammunition 250 may be engaged in the ammunition ejecting conduit 140 at the same time with the force exerted by the wheel 110 onto the ammunitions 250 providing the ammunitions 250 with the necessary kinetic energy to travel and exit the ammunition ejecting conduit 140.

Figure 13:
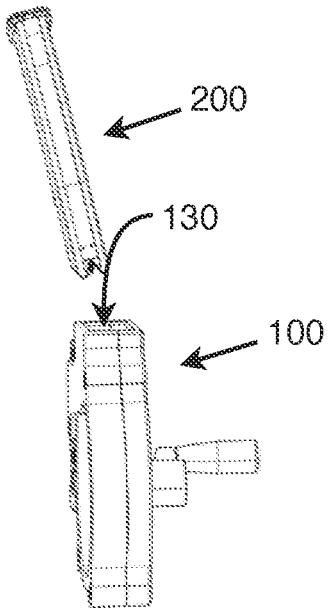
FIGS. 13 to 15 are front views of the magazine ammunition unloader during the process of loading a magazine therein in accordance with an embodiment.
Figure 14:
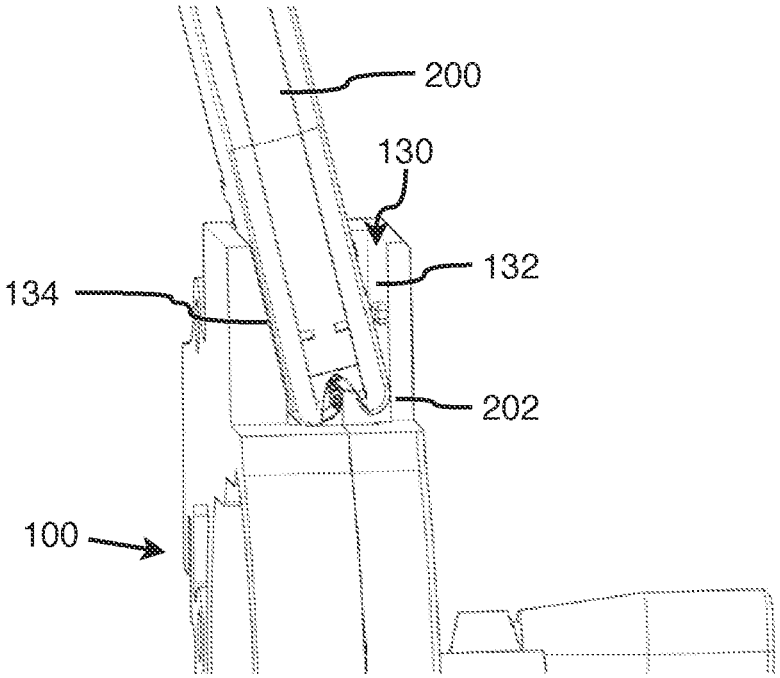
Figure 15:
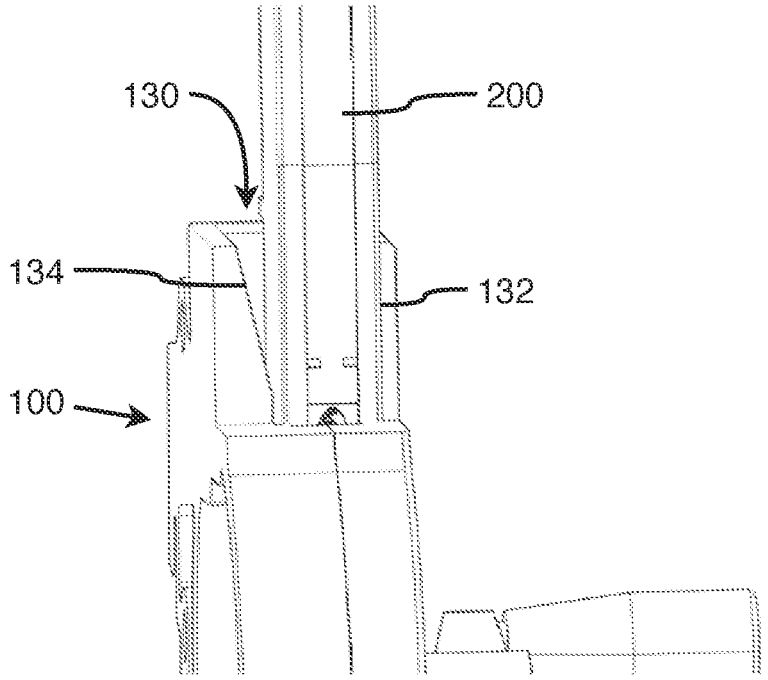

Referring to FIGS. 13 to 15, the magazine loading conduit 130 comprises a pair of opposed walls 132 and 134, one straight wall 132 and one sloped wall 134, with the general funnel shape of the magazine loading conduit 130 easing the insertion of the magazine 200 therein. Typical process of inserting a magazine 200 in the magazine loading conduit 130 consists in inserting the magazine 200 following the sloped wall 134 until the bottom end 202 of the magazine 200 contacts the opposed wall 132, and straightening the magazine 200 for the bottom end 202 of the magazine 200 ending its course in the magazine loading conduit 130.

Figure 16:
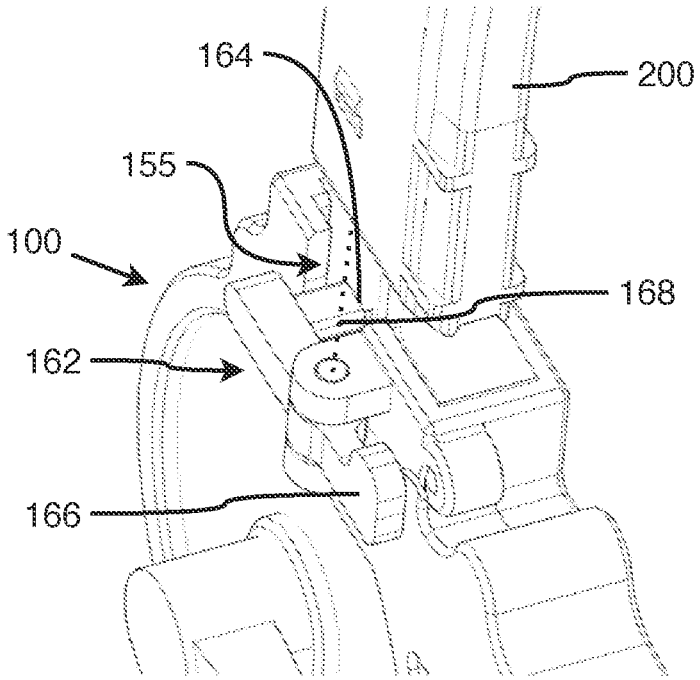
FIGS. 16 to 18 are close-up elevated perspective views of a portion of the magazine ammunition unloader being loaded with a magazine in accordance with an embodiment.
Figure 17:
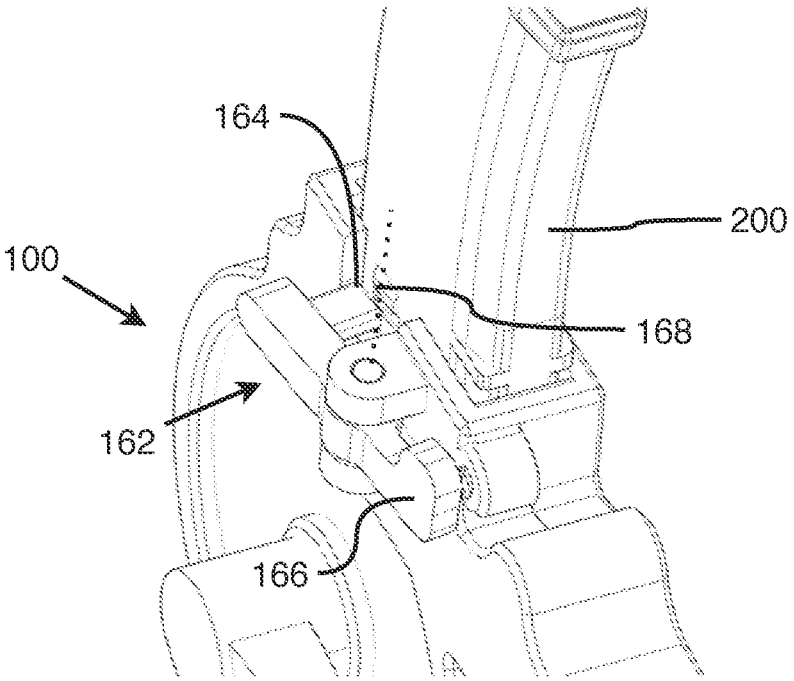
Figure 18:
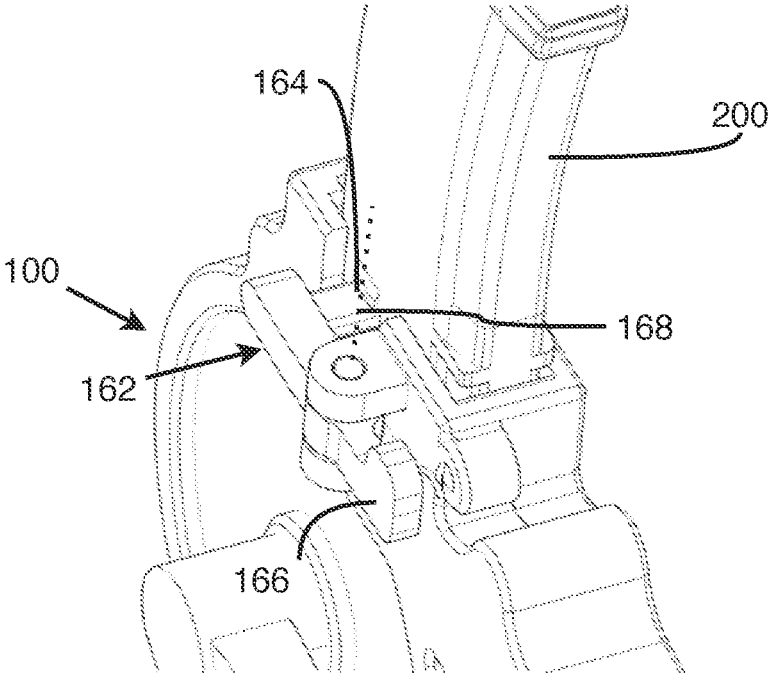

Referring to FIGS. 16 to 18, a magazine 200 is loaded into the magazine ammunition unloader 100. In a realization, a spring-loaded arm 162 mounted on a pivot axis 168 operates as a lock to secure the magazine 200 in place. On one side of the spring-loaded arm 162 is a pressable extremity 166 and at the other extremity is a securing abutment 164 adapted to travel through a clearance 155 on the side of the body 102 to contact and secure the magazine 200 in place once freed for an external force exerted over the pressable extremity 166. To release the magazine 200 from the magazine ammunition unloader 100, the user simply presses the pressable extremity 166, thereby releasing contact between the securing abutment 164 and the magazine 200, and thus allowing the magazine 200 to be released by simply pulling the magazine 200 up and away from the magazine ammunition unloader 100. FIGS. 16 to 18 depict respectively the magazine 200 before being loaded; the magazine 200 loaded in the magazine ammunition unloader 100 with the spring-loaded arm 162 away from the magazine 200; and the spring-loaded arm 162 restored to its default position, the securing abutment 164 securing the magazine 200 in place.

Referring to FIG. 19, the magazine ammunition unloader 100 is adapted to unload ammunitions 250 from a magazine 200 with the ammunitions 250 being stacked in a partial vertically overlapping fashion. The position and/or size of the wheel 110 is/are designed for the teeth 112 to contact the rear of the ammunitions 250 regardless of the ammunitions 250 being positioned left or right in the magazine 200, and the ammunition ejecting conduit 140 is sized to be able to receive the ammunitions 250 regardless of its original position (left or right) in the magazine 200.

According to a realization, the ammunition ejecting conduit 140 has a slightly funnel-like shape that corrects the direction of the ammunitions 250 engaged within such that the ammunitions 250 exiting the ammunition ejecting conduit 140 has the same exiting orientation.

Referring now to FIGS. 20 to 23, these Figures illustrate a magazine ammunition unloader 100, according to an embodiment, that is adapted to operate with an embodiment of an ammunition container 310. The magazine ammunition unloader 100 comprises an arm 170 comprising a counter-abutting face 172 distant and a hooking groove 174 distant from and opposed to the container abutting face 152. The combination of the container abutting face 152 and at least one of the counter-abutting face 172 and the hooking groove 174 is designed to wedge two opposed walls of the ammunition container 310 from the top to secure the magazine ammunition unloader 100 thereto when unloading ammunitions from the magazine 200 into the ammunition container 310.

It is worth noting that the preferred realization provides no permanent securing against the displacement of the magazine ammunition unloader 100 relative to the ammunition container 310. During the unloading process, the user may move left or right the magazine ammunition unloader 100 by lifting slightly the magazine ammunition unloader 100 above the top of the ammunition container 310. When a channel of the ammunition container 310 is full, this process allows to distribute efficiently the ammunitions into other slots and thus fills the ammunition container 310.

Figure 20:
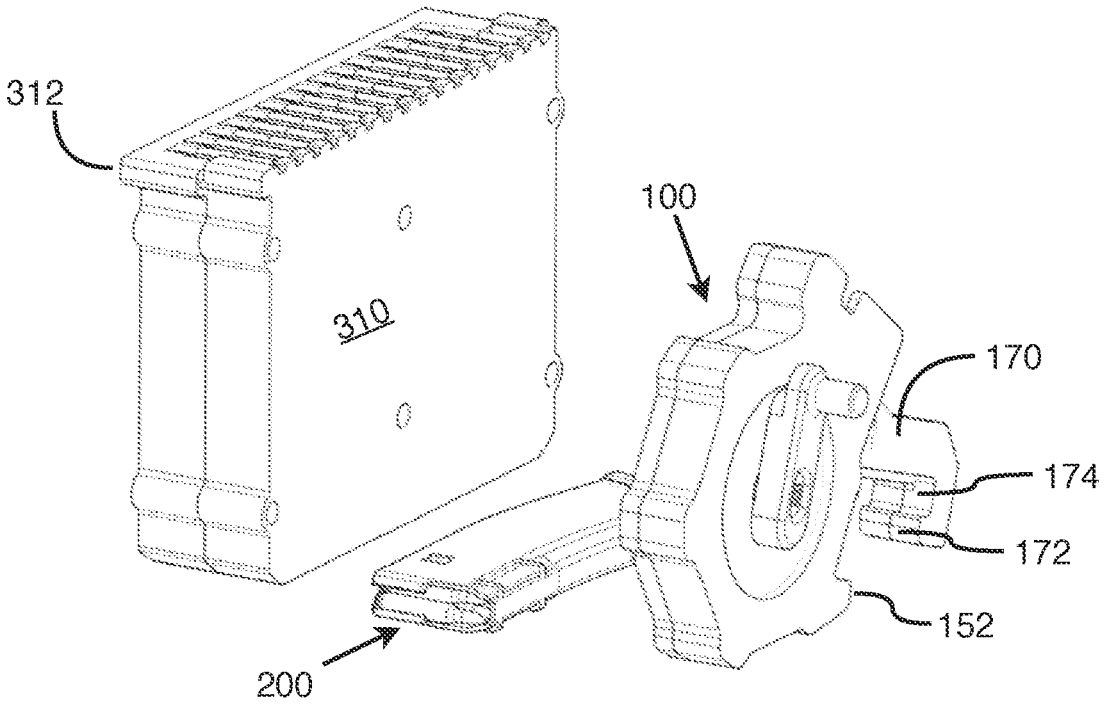
FIGS. 20 to 23 is a perspective view of a kit comprising a magazine ammunition unloader, an ammunition container, and a magazine in accordance with an embodiment.
Figure 21:
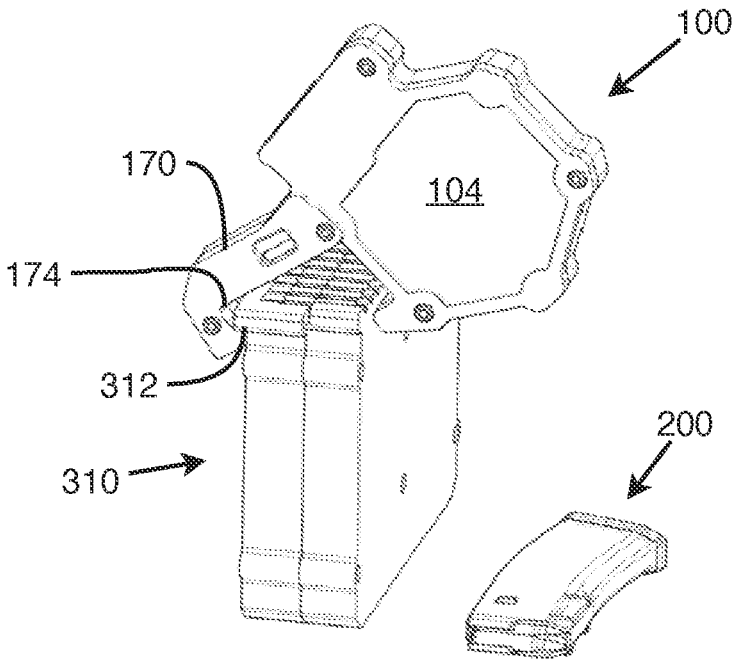
Figure 22:
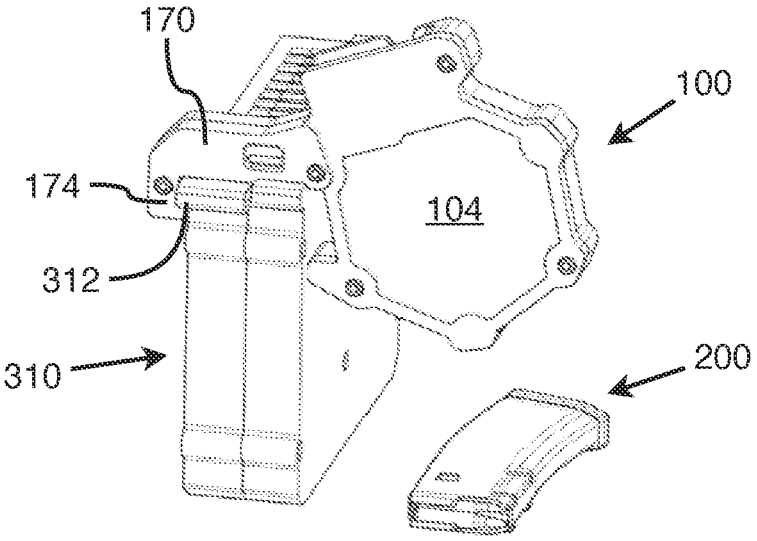

FIG. 20 depicts the magazine ammunition unloader 100, the magazine 200 and the ammunition container 310 before them being secured to each other. FIG. 21 depicts the process of mounting the magazine ammunition unloader 100 to the ammunition container 310, the arm 170 extended over the top of the ammunition container 310 and the hooking groove 174 interfacing with a rib 312 at the top of the second wall of the ammunition container 310. FIG. 22 depicts the magazine ammunition unloader 100 being secured to the ammunition container 310 by lowering the main-body portion 104 of the magazine ammunition unloader 100 until the bottom of the arm 170 abuts the top of the ammunition container 310, the rib 312 remaining in the hooking groove 174, and the container abutting face 152 abutting the side of the first wall. FIG. 23 depicts that, once the wheel 110 is secured to the ammunition container 310, the magazine 200 may be easily loaded in the magazine ammunition unloader 100.

Referring now to FIGS. 24 to 29, the steps in unloading a magazine 200 mounted in a magazine ammunition unloader 100 that is secured to the ammunition container 310 are depicted. The steps comprise driving the wheel 110 to expulse the ammunitions 250 from the magazine 200 until the ammunitions 250 fill up a slot of the ammunition container 310. The steps comprise moving the magazine ammunition unloader 100 sideways to fill a neighbor slot when required.

It is worth noting that the ammunition ejecting conduit 140 comprises, according to an embodiment, a side-slopped face 142 for ejecting the ammunitions 250 sideways into the slots of the ammunition container 310. By exiting the ammunitions 250 sideways rather than straight from the ammunition ejecting conduit 140, the magazine ammunition unloader 100 prevents a possible edge case resulting from an ammunition 250 jamming into a slot like a spear, which would prevent other rounds from being transferred into the slot.

Figure 28:
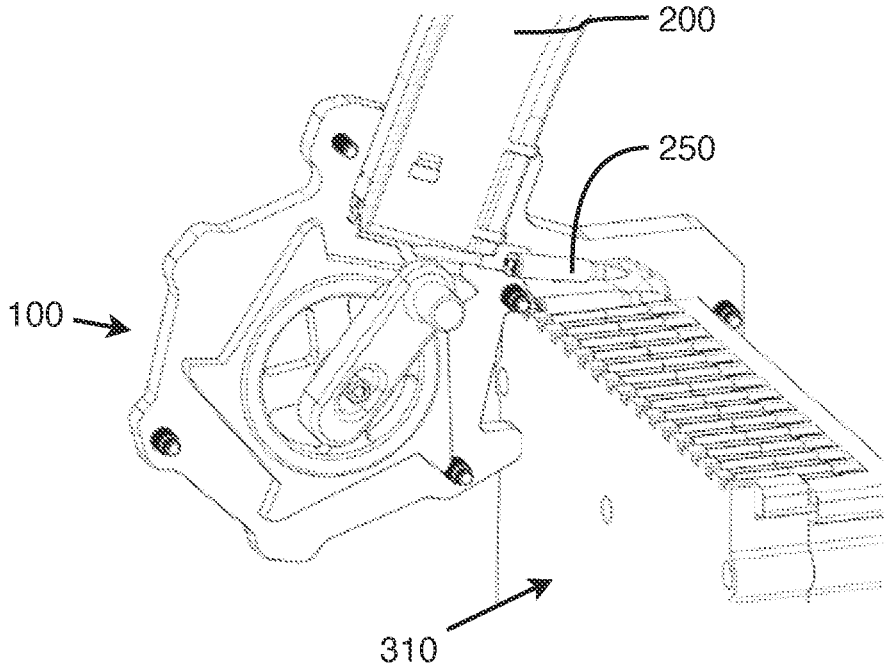
Figure 29:
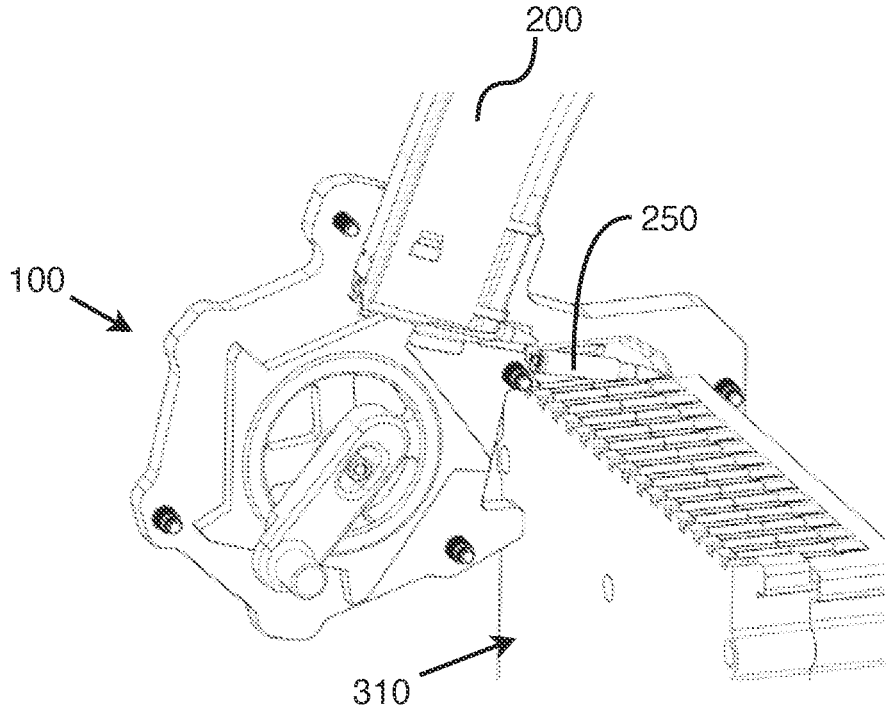

When a slot a filled up, as depicted through FIGS. 28 and 29, the combination of the magazine ammunition unloader 100 and the magazine 200 loaded therein are moved for the exit of the ammunition ejecting conduit 140 to be aligned with a neighbor slot, allowing to continue unloading the magazine 200. This process continues until the magazine 200 is empty, or until all slots of the ammunition container 310 are filled up.

Figure 30:
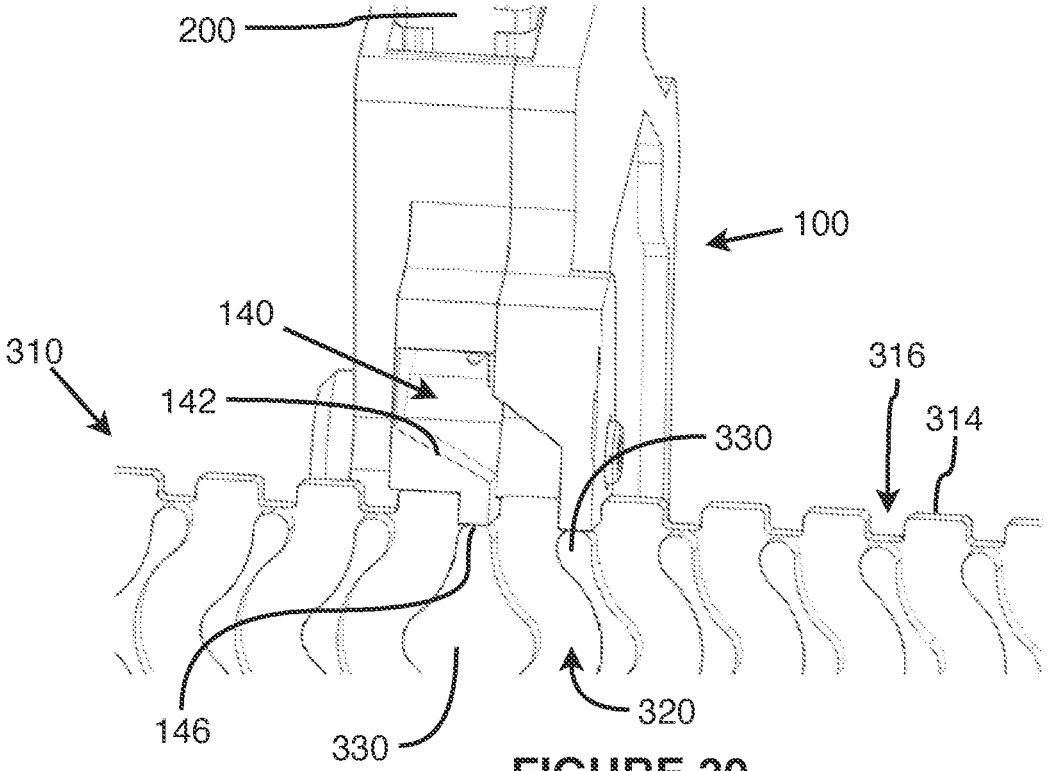
FIG. 30 is a cross-section view of a magazine ammunition unloader secured to an ammunition container in accordance with an embodiment, according to a view plan located between and parallel to the walls on which is secured the magazine ammunition unloader.

Referring to FIG. 30, cooperation between the magazine ammunition unloader 100 and the ammunition container 310 is depicted. It also depicts the side-slopped face 142 of the ammunition ejecting conduit 140 forcing the sideway course of the ammunitions 250 between where they are ejected from the magazine 200 and where they are exiting the ammunition ejecting conduit 140.

Figure 57:
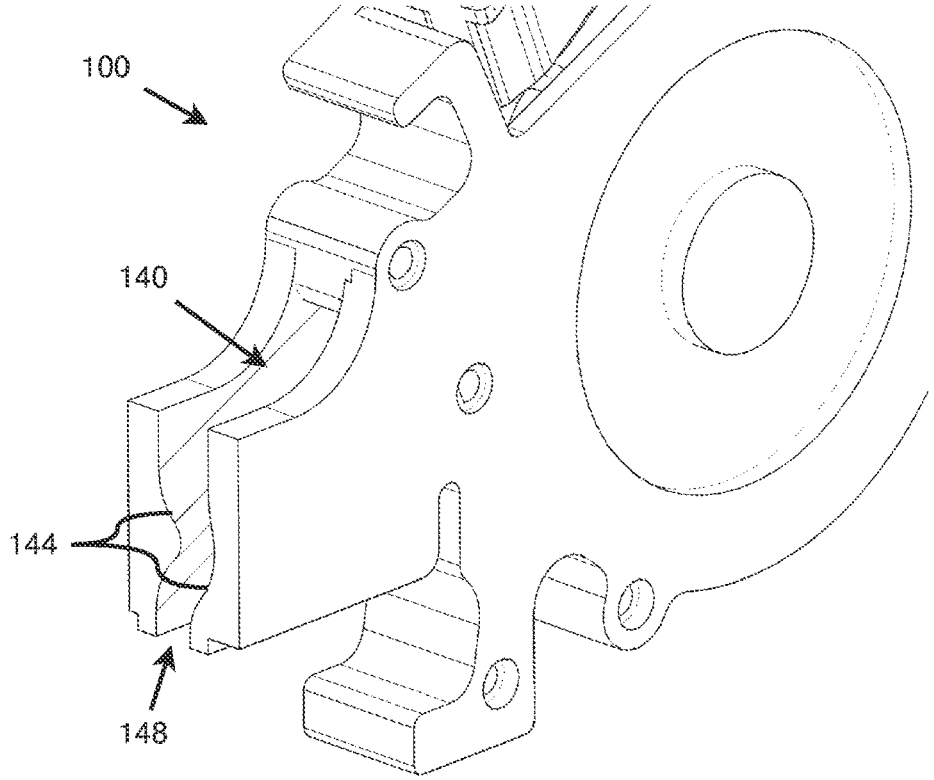
FIG. 57 is a perspective elevation view of the ammunition ejecting conduit showing its sinusoidal channel in accordance with an embodiment.

Referring to FIG. 57, according to another embodiment, the ammunition ejecting conduit 140 features a pair of sinusoidal walls 144 defining a sinusoidal channel 148 designed to smoothly guide through gravity ammunitions 250 outside the magazine ammunition unloader 100.

Back to FIG. 30, it further depicts the slots 320 of the ammunition container 310, divided by dividing walls 330. At least one of the first wall and the second wall of the ammunition container 310 comprises a series of evenly distributed projections 314 divided by gaps 316 interfacing with the bottom face of the arm 170, wherein the interface allows to easily align the exit of the ammunition ejecting conduit 140 with the entry of the slots 320. Moving the ammunition container 310 from being aligned with one slot 320 to a neighboring slot 320 demands lifting slightly the magazine ammunition unloader 100 above the projections 314, to move the magazine ammunition unloader 100 sideway and to lower the magazine ammunition unloader 100 with bottom end 146 of the magazine ammunition unloader 100 being lodged in with the gaps 316 neighboring the slot 320 to be filled.

Figure 36:
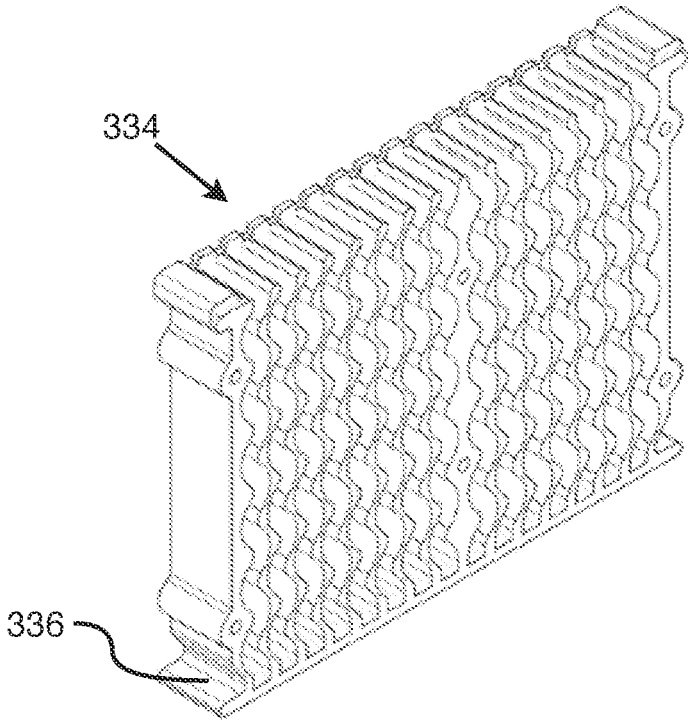

Typically, the slots 320 are sinusoidal, like depicted on FIG. 30 or 36.

Figure 31:
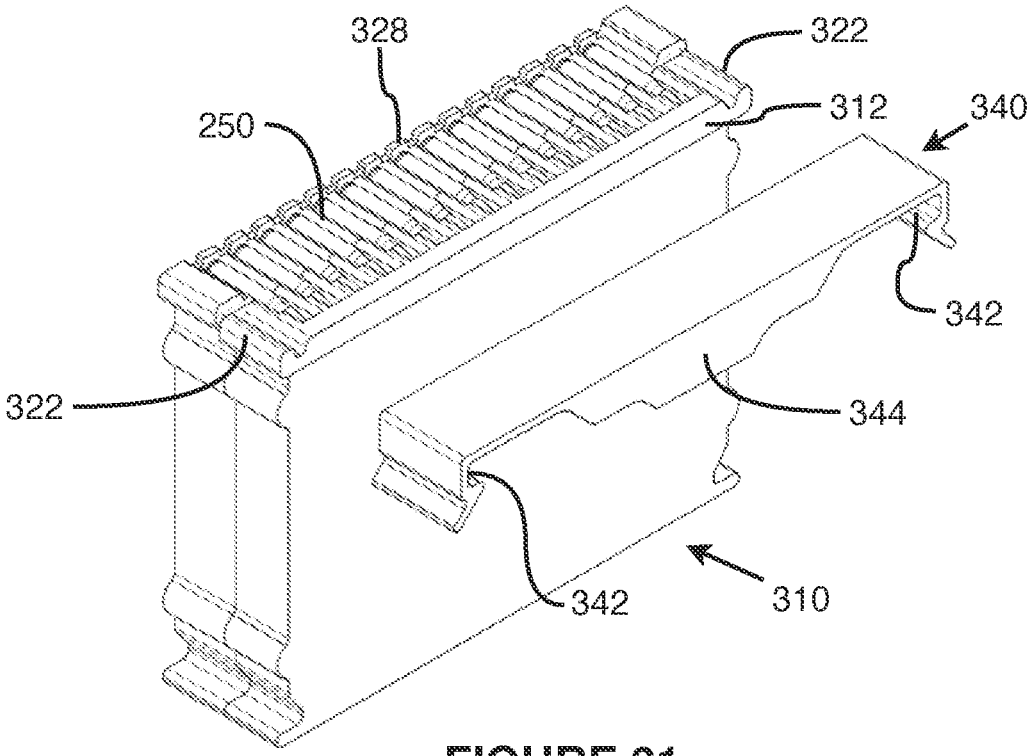
FIGS. 31 to 33 are perspective views of respectively an ammunition container and a lid, the lid when in process of being secured to the ammunition container, and the lid secured to the ammunition container in accordance with an embodiment.
Figure 32:
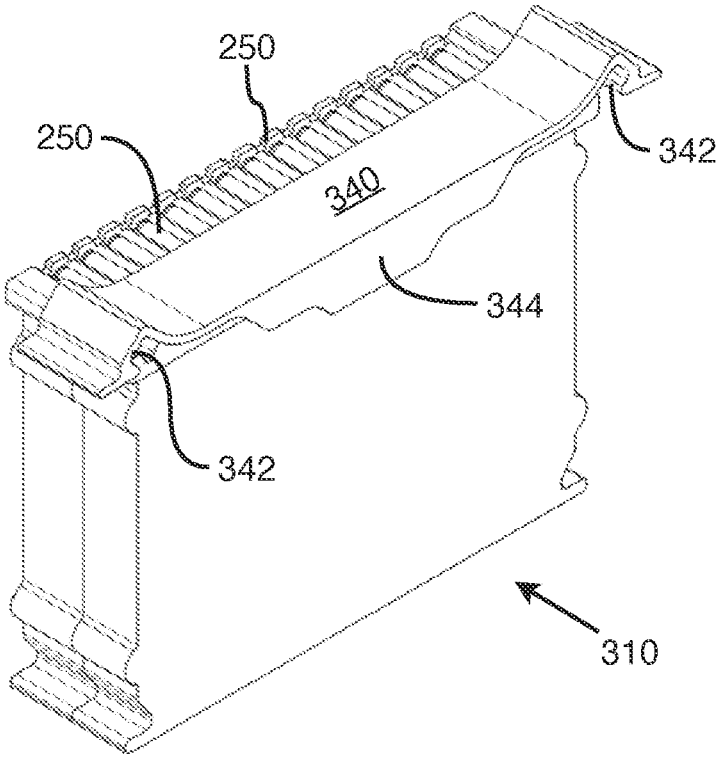
Figure 33:
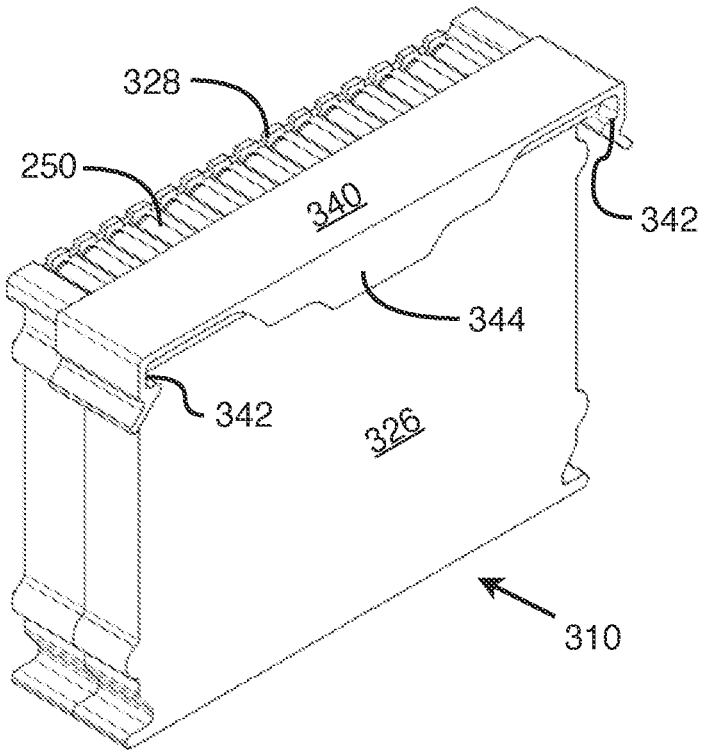

Referring to FIGS. 31 to 33, the ammunition container 310 may be provided with a removable lid 340. According to an embodiment, the lid 340 is secured to the ammunition container 310 through an interaction between the ribs 322 and the channels 342. The lid 340 may be elastically deformable (see FIG. 32) to be secured by the top of the ammunition container 310. When the edges about the channels 342 are released (see FIG. 33), the ribs 322 are set in the channels 342.

According to a realization, the transversal dimension of the lid 340, over at least a portion of its length, when compared to the ammunition container 310 to be installed onto, covers has a section designed to partially cover the open top of the ammunition container 310, in other words, that is smaller than the distance between the walls 326 and 328, thereby providing a top-open portion allowing a user to see the number of slots 320 of the ammunition container 310 that are filled up with ammunitions 250.

According to a realization, the lid 340 comprises a butt wall 344 adapted to abut the wall 326, wherein the butt wall 344 eases the transversal placement of the lid 340 over the ammunition container 310.

Figure 34:
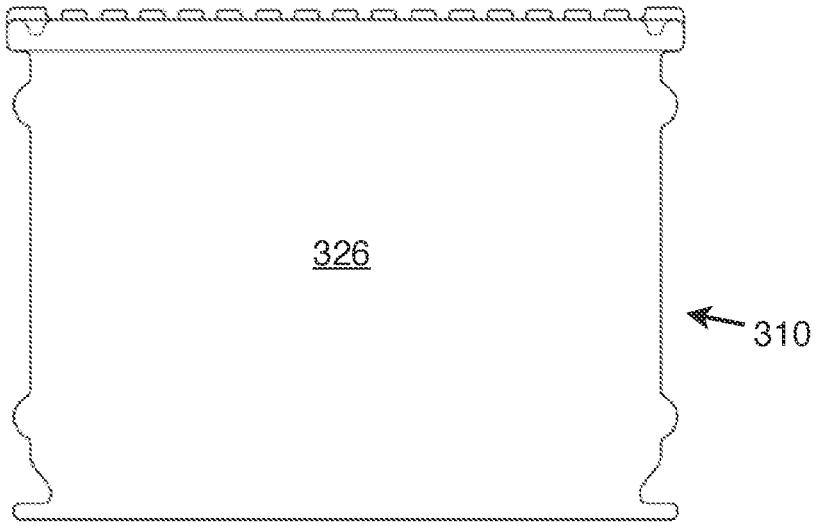
FIG. 34 is a front view of an ammunition container in accordance with an embodiment.
Figure 35:
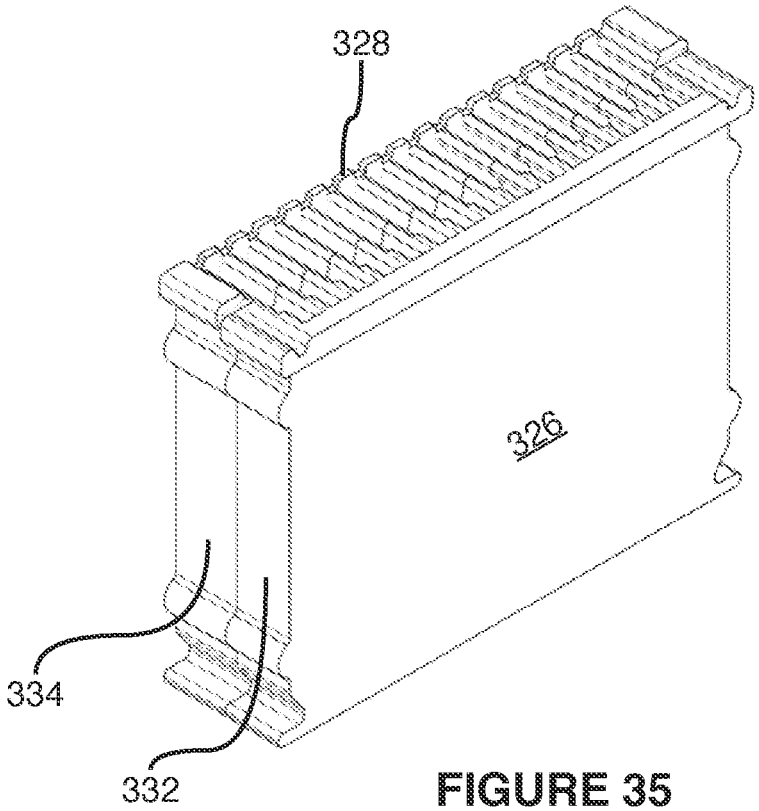
FIGS. 35 and 36 a perspective view of the ammunition container of FIG. 34.

Referring to FIGS. 34 to 36, the ammunition container 310 comprises a first half body 332 and a second half body 334 each comprising dividing walls 330 bordering slots 320. The half bodies 332 and 334 are adapted to be secured to each other, the open portion facing each other such that the dividing walls 330 of the half bodies 332 and 334 are joining to define slots 320 extending over the whole space between the walls 326 and 328.

Figure 37:
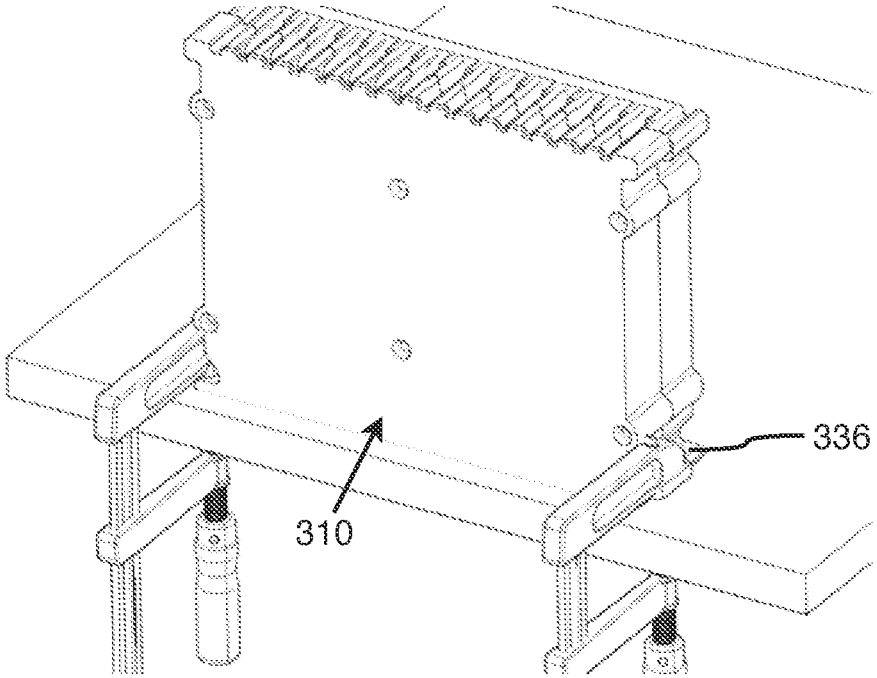
FIG. 37 is a perspective view depicting the ammunition container of FIG. 34 secured to a table.
Figure 38:
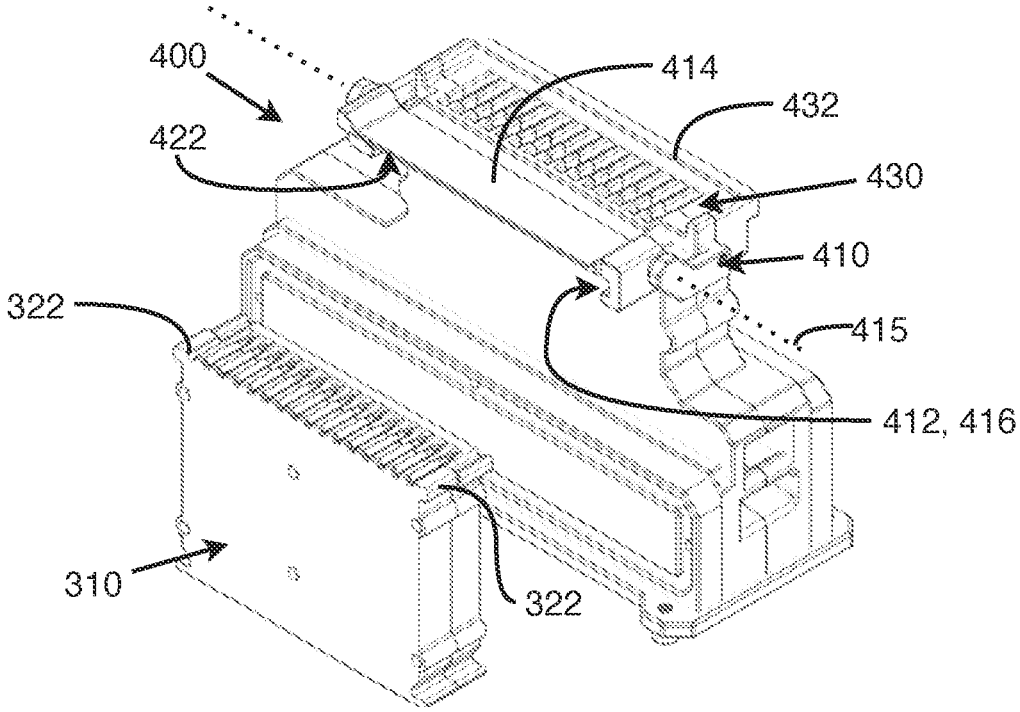
FIGS. 38 to 41 are perspective views respectively of an ammunition container of FIG. 20 before interfacing with a loading interface support mounted to a magazine loader, interfacing with the open top of the ammunition container facing up, the ammunition container being rotated, and the open top of the ammunition container facing down in accordance with an embodiment.

Referring additionally to FIG. 37, the ammunition container 310 comprises securing means, e.g., wings 336 at its base adapted to be wedged using e.g., clamps to temporarily secure the ammunition container 310 to e.g., a table. The ammunition container 310 may thus be used in cooperation with the magazine ammunition unloader 100 in a stable fashion.

Figure 58:
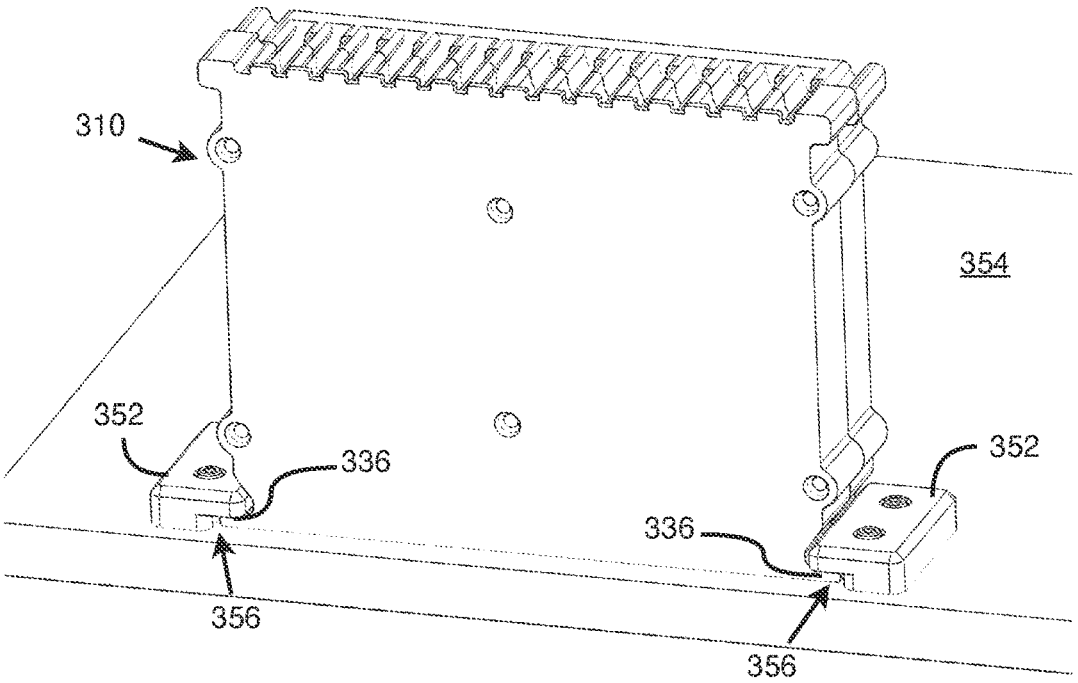
FIG. 58 is a perspective elevation view of an ammunition container mounted to a table using fittings in accordance with an embodiment.

Referring to FIG. 58, e.g., according to an embodiment, fittings 352 mounted to a support, e.g., table 354, are defining a groove 356 that may be used to releasably mount the ammunition container 310 to the table 354, According to an embodiment, the grooves 356 are sized to wedge the wings 336 in-between. The available clearance in the grooves 356 after the wings 336 are inserted into further allows to slide the ammunition container 310 parallel to the grooves 356 to easily insert the ammunition container 310 thereinto and dismount the ammunition container 310 therefrom.

The present description also contemplates other means of securing the ammunition container 310 to a surface, with the securing means being part of the ammunition container 310, of the support, or of a combination of parts being part of the support and part of the ammunition container 310.

Referring to FIGS. 38 to 41, a filling container, e.g., the ammunition container 310, is operable in cooperation with a receiving container, e.g., the magazine loader 400. The ammunition container 310 may be placed to interface with the magazine loader 400 through a loading interface 416 mounted to the magazine loader 400.

The loading interface 416 comprises a container interface 422 comprising a plate 414 and a pair of channels 412 about the extremities of the plate 414, wherein the channels 412 are adapted to slidingly interface with the ribs 322 of the ammunition container 310 to have the ammunition container 310 secured to the loading interface 416.

The container interface 422 is adapted to be rotated around an axis 415 from a normal position wherein the open top of the ammunition container 310 faces up, to a loading position wherein the open top of the ammunition container 310 faces downward. At the normal position, the loading position, and during the rotation of the ammunition container 310, the plate 414 is preventing ammunitions 250 from exiting the slots 320.

The loading interface 416 further comprises a magazine loader interface 430 adapted to receive the top of the ammunition container 310 once the ammunition container 310 is turned upside down. The magazine loader interface 430 has a shape providing clearance for access to slots of the magazine loader 400, at least partially surrounded by a floor portion 432 adapted for the top of the ammunition container 310 to slide on or above as a user slides the ammunition container 310 out of the channels 412 toward the open top of the magazine loader 400.

According to an alternative realization, the magazine loader interface 430 is an integral part of the magazine loader 400.

Figure 42:
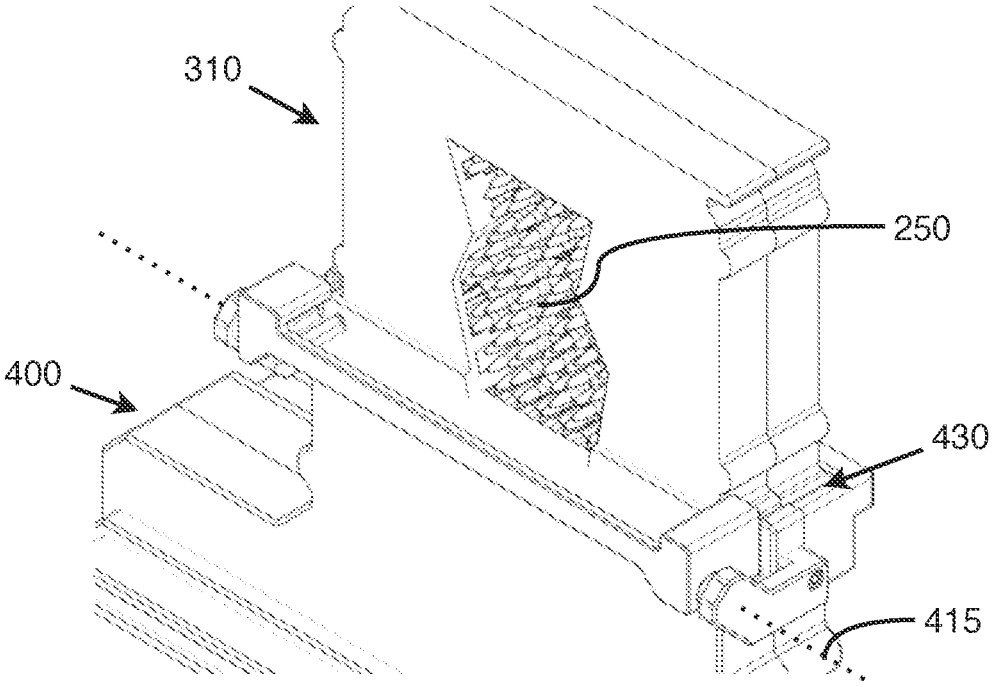
FIG. 42 is a perspective view of a portion of an ammunition container and the magazine loader of FIG. 38 is an interfacing position, with a portion of a side wall of the ammunition container removed.

Referring additionally to FIG. 42, it is worth noting that when the ammunition container 310 is sled out of the channels 412, the plate 414 gradually stops hindering the exits of the slots 320. When sled to its maximum position out of the channels 412, the open tops of the ammunition container 310 and of the magazine loader 400 are fully facing themselves, with the plate 414 not hindering anymore the course of the ammunitions 250, allowing the ammunitions 250 loaded in the ammunition container 310 to drop from the container slots 320 into the corresponding slots 428 of the magazine loader 400.

Figure 43:
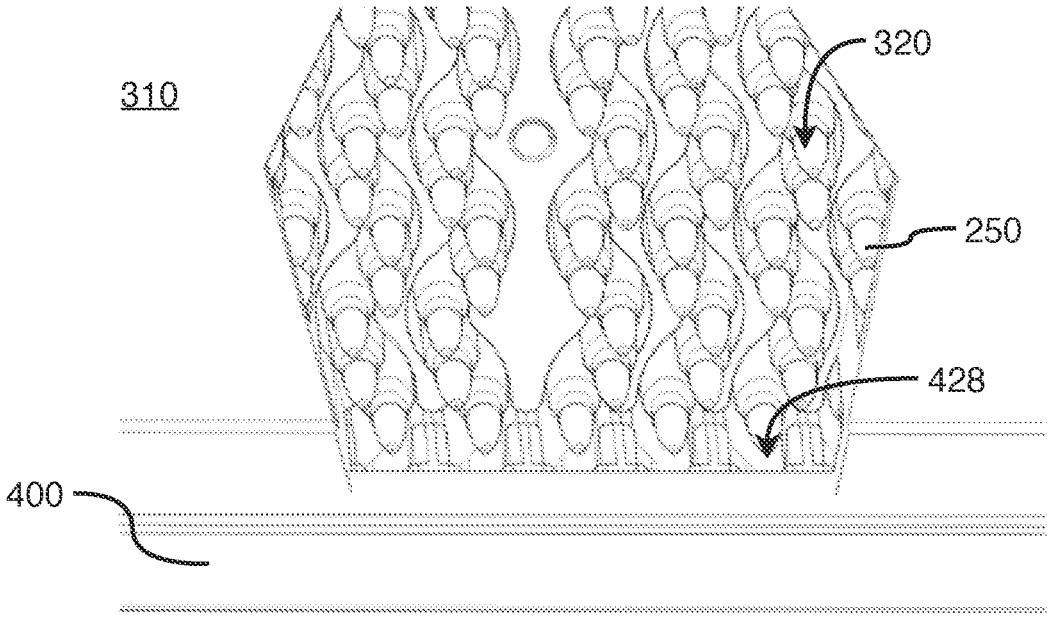
FIGS. 43 to 45 are perspective views of an ammunition container interfacing with a magazine loader respectively at the beginning of the transfer of the ammunitions, during the transfer and when the transfer of the ammunitions from the ammunition container into the magazine loader is done.
Figure 44:
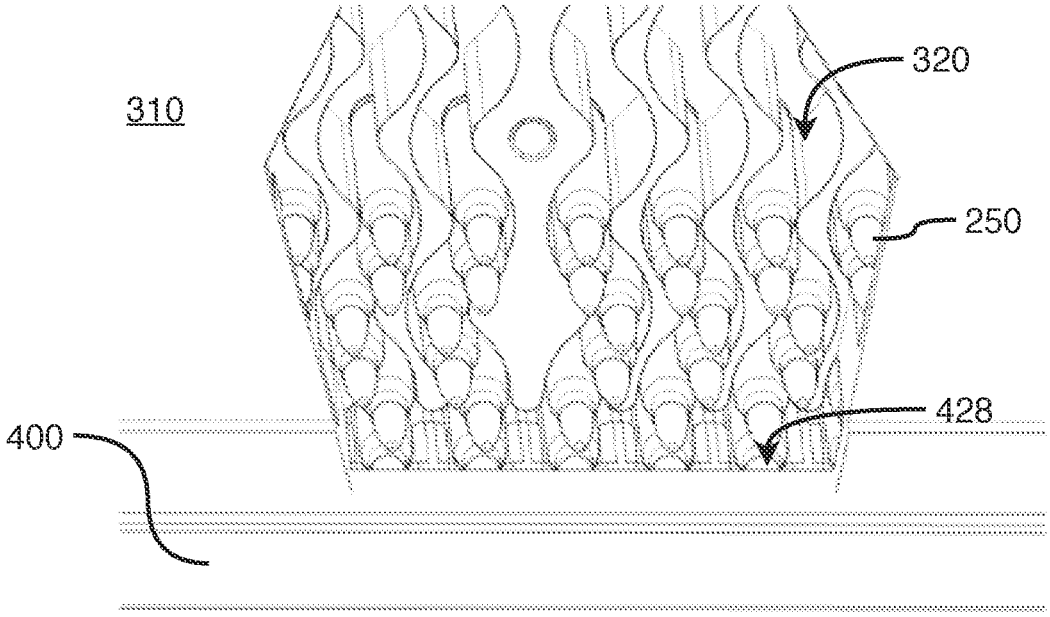
Figure 45:
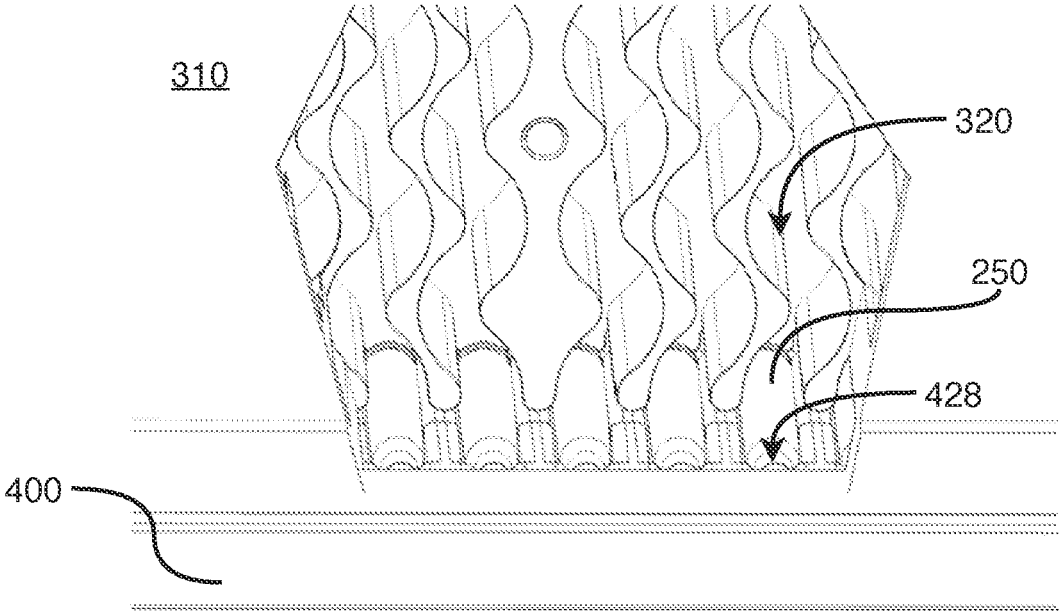

FIGS. 43 to 45 depict the ammunitions 250 travelling from the ammunition container 310 to the magazine loader 400 when the open tops of the ammunition container 310 and the magazine loader 400 are appropriately aligned. As discussed, when the ammunition container 310 is not pushed at the appropriate position, the plate 414 forces the ammunitions 250 to remain in the ammunition container 310.

It is further illustrated therethrough that the slots 320 and 428 are appropriately aligned to prevent the ammunitions from wedging during their course between the ammunition container 310 and the magazine loader 400.

Figure 46:
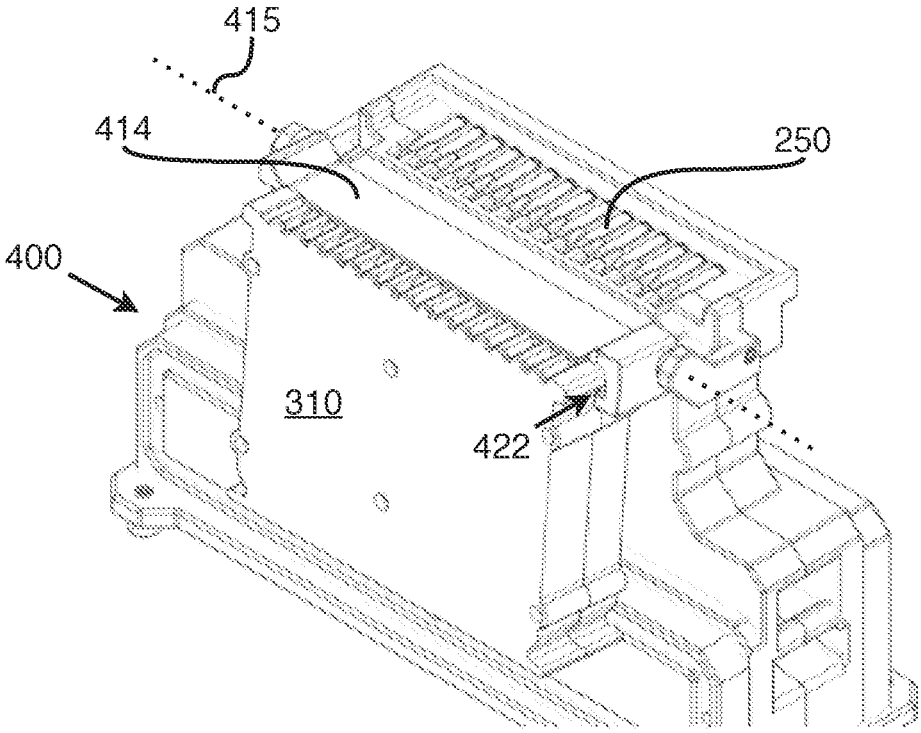
FIG. 46 is a perspective view of the ammunition container and the magazine loader once the ammunition container is emptied into the magazine loader and the ammunition container rotated back to its open top facing upward.
Figure 47:
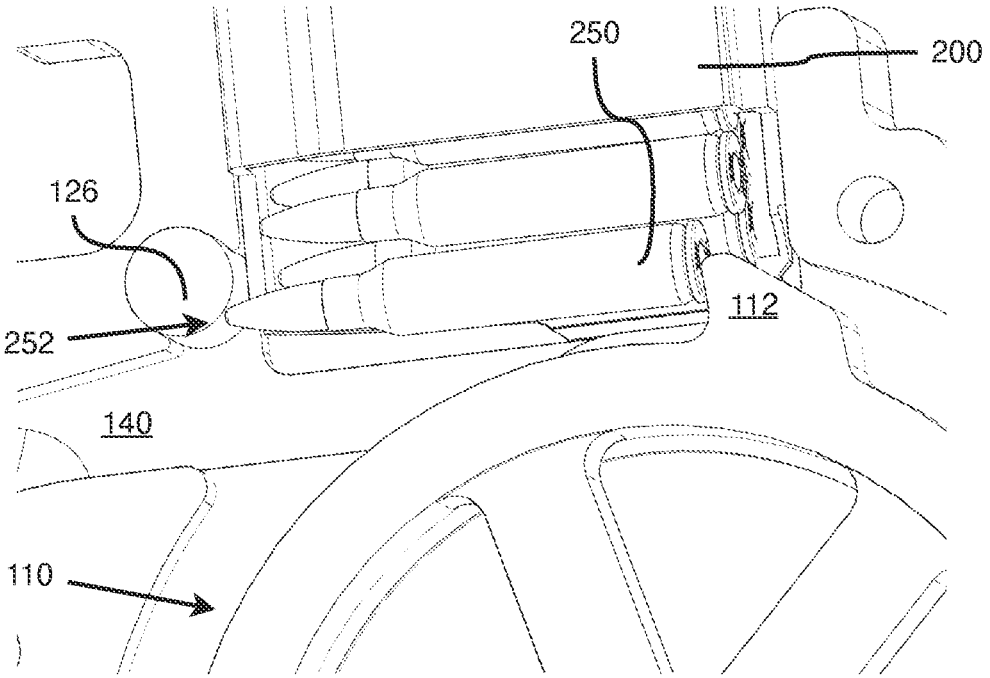
FIGS. 47 to 50 are elevation perspective views depicting the interaction of an ammunition during its ejection from the magazine with the directing roller directing the ammunition, the figures depicting a sequence in the ammunition ejection process in accordance with an embodiment.
Figure 48:
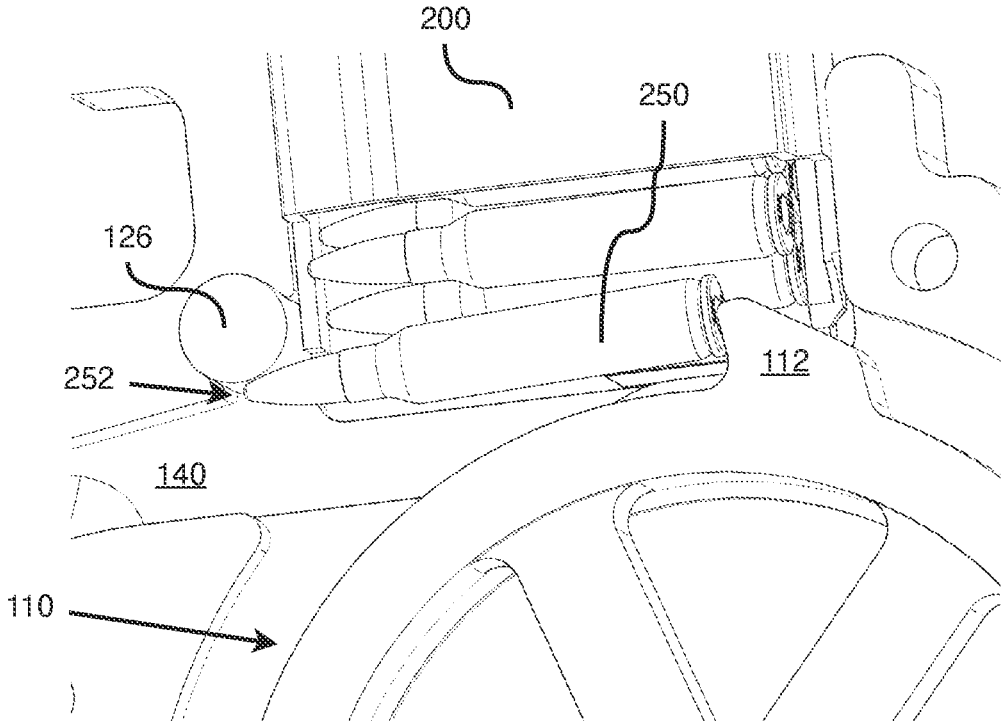
Figure 49:
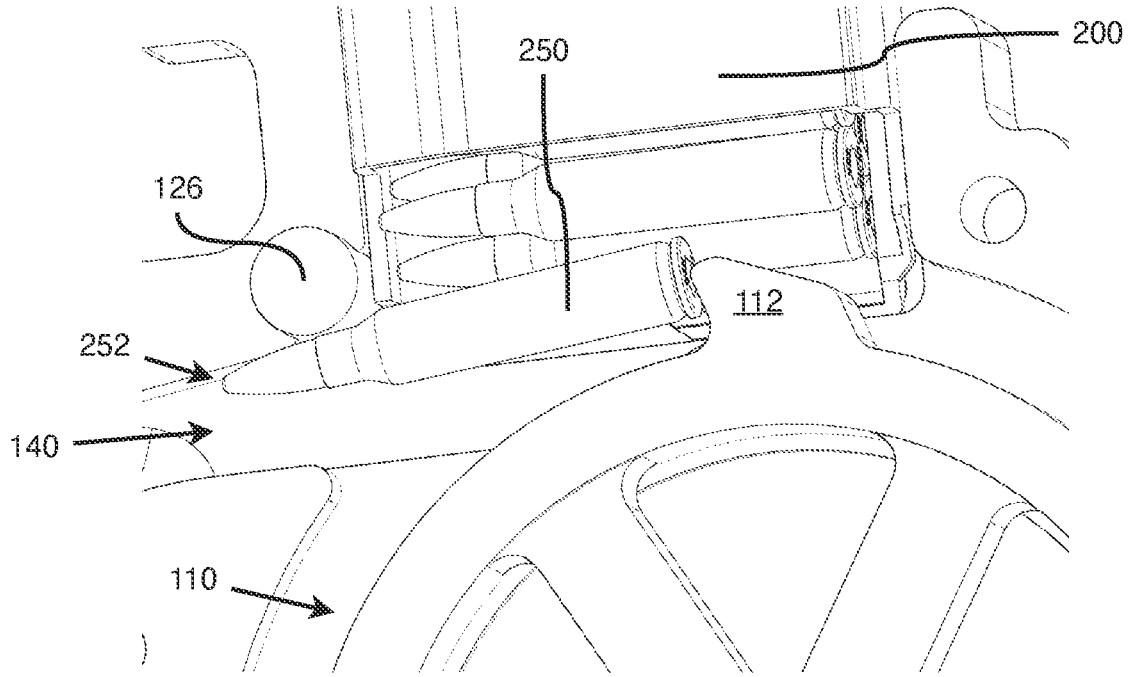
Figure 50:
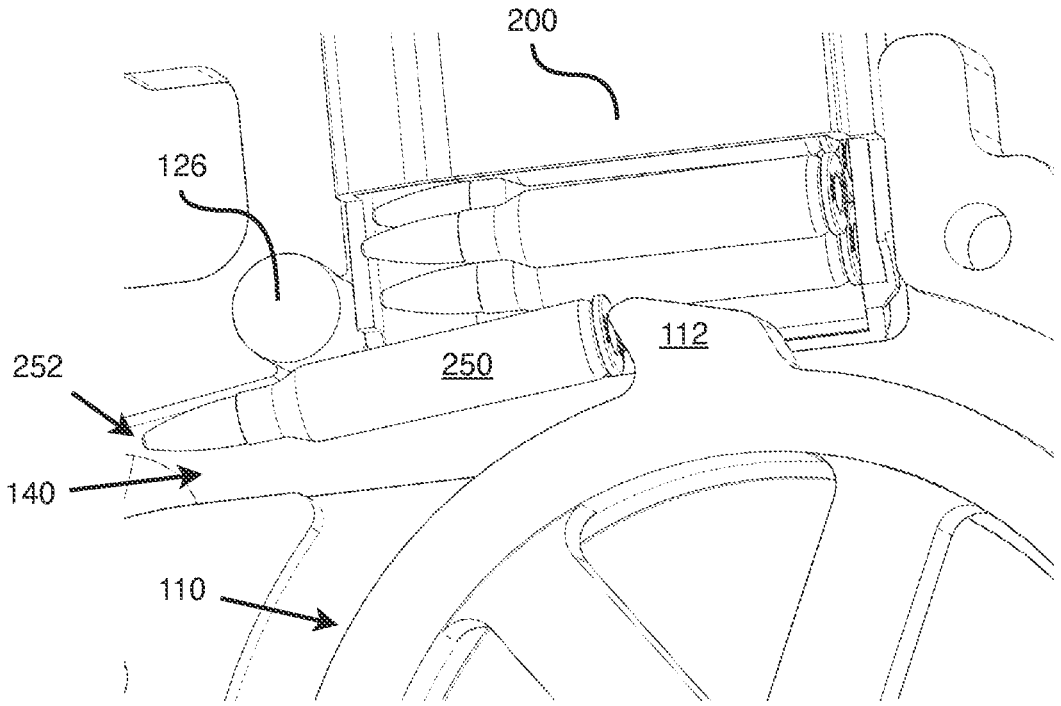

Referring to FIG. 46, once the ammunition container 310 is emptied, the ammunition container 310 is sled back toward the back of the channels 412, in which position the ammunition container 310 may be rotated back to a normal position wherein the open top faces upward. In that normal position, the ammunition container 310 may be easily removed from the rotative support 410 by simply sliding the ammunition container 310 out of the channels 412 away from the magazine loader 400.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A magazine ammunition unloader comprising:

a body comprising:

a magazine loading conduit adapted to receive a magazine containing ammunitions and the ammunitions contained in the magazine; and an ammunition ejecting conduit connected to the magazine loading conduit; and a wheel housed in the body, the wheel comprising a tooth adapted to push one at the time the ammunitions from the magazine into the ammunition ejecting conduit; and a handle adapted to drive the wheel, thereby ejecting one at the time the ammunitions from the magazine;

wherein the body comprises a main part housing the wheel, and an arm extending from the main part and the arm comprising a hook portion, wherein the main part and hook portion are configured to mount the magazine ammunition unloader to an ammunition container.

2. The magazine ammunition unloader of claim 1, wherein the wheel comprises at least one tooth.

3. The magazine ammunition unloader of claim 2, wherein the ammunitions comprises a rear face, and wherein the tooth comprises a pushing face for pushing the rear face of a pushed one of the ammunitions.

4. The magazine ammunition unloader of claim 3, wherein the pushing face is sloped frontward and outward relative to a radius line of wheel.

5. The magazine ammunition unloader of claim 3, wherein the tooth comprises a top face for preventing a next one of the ammunitions to penetrate in the ammunition ejection conduit when the pushing face push the rear face of the pushed ammunition.

6. The magazine ammunition unloader of claim 1, further comprising a roller rotatably mounted at a junction of the magazine loading conduit and the ammunition ejecting conduit.

7. The magazine ammunition unloader of claim 6, wherein the ammunition ejecting conduit comprises walls, and wherein the roller extends inwardly into the ammunition ejecting conduit beyond one of the walls of the ammunition ejecting conduit.

8. The magazine ammunition unloader of claim 1, further comprising locking mechanism adapted to releasably lock the magazine in the magazine loading conduit.

9. The magazine ammunition unloader of claim 8, wherein the locking mechanism comprises a spring-loaded arm.

10. The magazine ammunition unloader of claim 1, wherein the magazine loading conduit comprises a first wall and a second wall opposed to the first wall, wherein the first wall and the second wall are not parallel to each other.

11. The magazine ammunition unloader of claim 1, wherein the arm is rotatably joined to the main part of the body.

12. The magazine ammunition unloader of claim 1, wherein the body further comprises an abutting face, wherein the abutting face and the hook portion are cooperate into mounting the magazine ammunition unloader to the ammunition container.

13. The magazine ammunition unloader of claim 1, wherein the ammunition ejecting conduit comprises a bottom end defining protrusions and recesses designed to cooperate with projections and gaps of an ammunition container.

14. The magazine ammunition unloader of claim 1, wherein the hook portion comprises a mounting groove facing at least partially away from the magazine loading conduit, and wherein the magazine ammunition unloader further comprises an ammunition ejection conduit distant from the mounting groove.

15. The magazine ammunition unloader of claim 1, wherein the ammunition ejection conduit is oblique relative to the mounting groove.

16. The magazine ammunition unloader of claim 1, wherein the hook portion comprises a front portion farthest to the wheel, wherein the ammunition ejection conduit is oblique relative to the front portion.

17. The magazine ammunition unloader of claim 1, wherein the ammunition ejection conduit is straight.

18. The magazine ammunition unloader of claim 1, wherein the ammunition ejection conduit is bordered on four sides between where the ammunition ejection conduit intersects with the magazine loading conduit and about the hook portion.

* * * * *